US007984703B2

(12) United States Patent
Hiraga

(10) Patent No.: US 7,984,703 B2
(45) Date of Patent: Jul. 26, 2011

(54) DECOMPRESSION MECHANISM

(75) Inventor: Takashi Hiraga, Kakogawa (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 241 days.

(21) Appl. No.: 12/481,466

(22) Filed: Jun. 9, 2009

(65) Prior Publication Data

US 2009/0301419 A1 Dec. 10, 2009

(30) Foreign Application Priority Data

Jun. 10, 2008 (JP) ..... 2008-152004

(51) Int. Cl.
*F01L 13/08* (2006.01)

(52) U.S. Cl. ..... 123/182.1

(58) Field of Classification Search ..... 123/90.27, 123/90.6, 182.1
See application file for complete search history.

(56) References Cited

U.S. PATENT DOCUMENTS 3,511,219 A * 5/1970 Esty ..... 123/182.1
5,816,208 A * 10/1998 Kimura ..... 123/182.1
6,250,271 B1 * 6/2001 Ikuma et al. ..... 123/182.1
6,543,403 B2 * 4/2003 Kawamoto ..... 123/182.1
6,578,540 B2 * 6/2003 Kawamoto ..... 123/193.5
7,137,375 B2 * 11/2006 Maeda et al. ..... 123/182.1
7,216,619 B2 * 5/2007 Sugiura et al. ..... 123/182.1
7,261,077 B2 * 8/2007 Asano et al. ..... 123/182.1
7,699,035 B1 * 4/2010 Havlik et al. ..... 123/182.1

FOREIGN PATENT DOCUMENTS

JP 2001-173421 6/2001

* cited by examiner

*Primary Examiner* — Hai H Huynh
(74) *Attorney, Agent, or Firm* — Alleman Hall McCoy Russell & Tuttle LLP

(57) ABSTRACT

A decompression mechanism provided in a valve operating system configured to drive a valve for opening and closing a port, includes an accommodating member provided in the valve operating system; a decompression member which is accommodated in the accommodating member such that the decompression member is extendable and retractable, the decompression member being configured to extend from the valve operating system to press the valve to open the port in a compression stroke of the engine; and an insertion member which is inserted into the valve operating system, the insertion member being configured to be inserted through the accommodating member in a direction crossing a direction in which the decompression member is extendable and retractable.

7 Claims, 19 Drawing Sheets

DECOMPRESSION MECHANISM

TECHNICAL FIELD

The present invention relates to a decompression mechanism which is configured to release a part of compressed air from a combustion chamber in an internal combustion engine to reduce a torque required to compress an air-fuel mixture in the combustion chamber at the start of the internal combustion engine.

BACKGROUND ART

FIG. 19 is a view showing a decompression mechanism 100 according to a prior art. Japanese Laid-Open Patent Application Publication No. 2001-173421 discloses a decompression mechanism 100 which is configured to slightly open an exhaust port to reduce a compressive pressure when compressing an air-fuel mixture in the interior of a cylinder, as a mechanism for reducing a start torque at the start of an engine. The decompression mechanism 100 is provided at an exhaust cam 101, and includes a sleeve 102, a decompression pin 103, and a decompression shaft 104. The sleeve 102 accommodates the decompression pin 103 such that the decompression pin 103 is extendable and retractable. The sleeve 102 is fitted into an accommodating hole 105 of the exhaust cam 101. The decompression shaft 104 causes the decompression pin 103 within the sleeve 102 to be extended and retracted.

The decompression pin 103 has a structure in which a tip end portion 103*a* protrudes from a cam surface 101*a* of the exhaust cam 101 at the start of an engine and is configured to contact a locker arm in a compression stroke of the engine. Thereby, an exhaust valve is pressed down in the compression stroke, slightly opening an exhaust port. This reduces a start torque which is required to move the piston up to a top dead center. After start of the engine, the tip end portion 103*a* of the decompression pin 103 is retracted to be inward relative to the cam surface 101*a*. For this reason, after the start of the engine, the exhaust valve is not pressed down in the compression stroke and the exhaust port is closed, so that the air-fuel mixture can be compressed with a higher pressure than the pressure at the start of the engine.

In the structure of the publication No. 2001-173421, in which the decompression mechanism 100 is provided at the exhaust cam 101, when the exhaust cam 101 rotates, a centrifugal force which causes the sleeve 102 to come off from the exhaust cam 101 is applied to the sleeve 102. To avoid the sleeve 102 coming off from the exhaust cam 101 due to the centrifugal force, the sleeve 102 needs to be accommodated in an accommodating hole 105 by an interference fit and fixed to the exhaust cam 101. However, since the interference fit causes reduction in a tolerance of the accommodating hole 105 and the sleeve 102, high dimension accuracy is needed. Therefore, forming the exhaust cam 101 and the sleeve 102 is time-consuming work. In addition, incorporating the decompression mechanism 100 in the exhaust cam 103 is also time-consuming work. Such a situation occurs in a valve operating system other than the locker arm valve operating system.

SUMMARY OF THE INVENTION

The present invention addresses the described condition, and an object of the present invention is to provide a decompression mechanism which can be easily incorporated into a valve operating system.

A decompression mechanism provided at a valve operating system configured to drive a valve for opening and closing a port, of the present invention, comprises an accommodating member provided in the valve operating system; a decompression member which is accommodated in the accommodating member such that the decompression member is extendable and retractable, the decompression member being configured to extend from the valve operating system to press the valve to open the port in a compression stroke; and an insertion member which is inserted into the valve operating system, the insertion member being configured to be inserted through the accommodating member in a direction crossing a direction in which the decompression member is extendable and retractable.

In accordance with the present invention, it is possible to avoid the accommodating member coming off from the valve operating system with a simple structure in which the insertion member is inserted into the valve operating system. This makes it possible to easily incorporate the decompression mechanism in the valve operating system. As a result, the productivity of the decompression mechanism can be improved.

The above and further objects and features of the invention will be more fully apparent from the following detailed description with accompanying drawings.

DETAILED DESCRIPTION OF THE INVENTION

Hereinafter, an embodiment of the present invention will be described with reference to the drawings. As used herein, the directions are referenced from the perspective of a driver mounting a motorcycle.

[Motorcycle]

Figure 1:
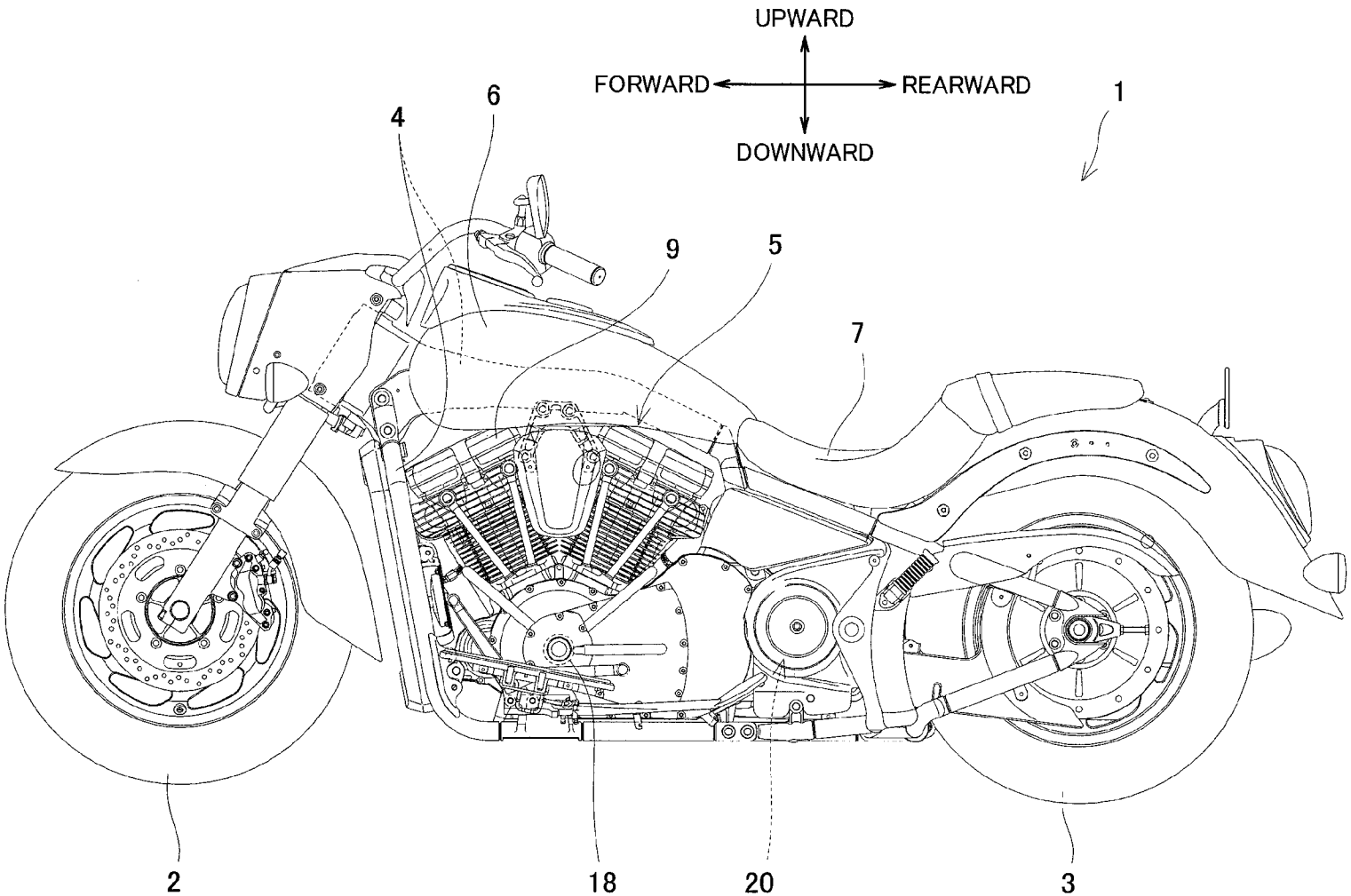
FIG. 1 is a left side view of a motorcycle according to an embodiment of the present invention.

FIG. 1 is a left side view of a motorcycle 1 according to an embodiment of the present invention. The motorcycle 1 is a cruiser-type motorcycle, and has a frame 4 forming a vehicle body between a front wheel 2 and a rear wheel 3. A fuel tank 6 is disposed at an upper portion of a front side of the frame 4. Behind the fuel tank 6, a driver seat 7 is disposed. Below the fuel tank 6, an engine 5 is mounted to the frame 4.

[Engine]

Figure 2:
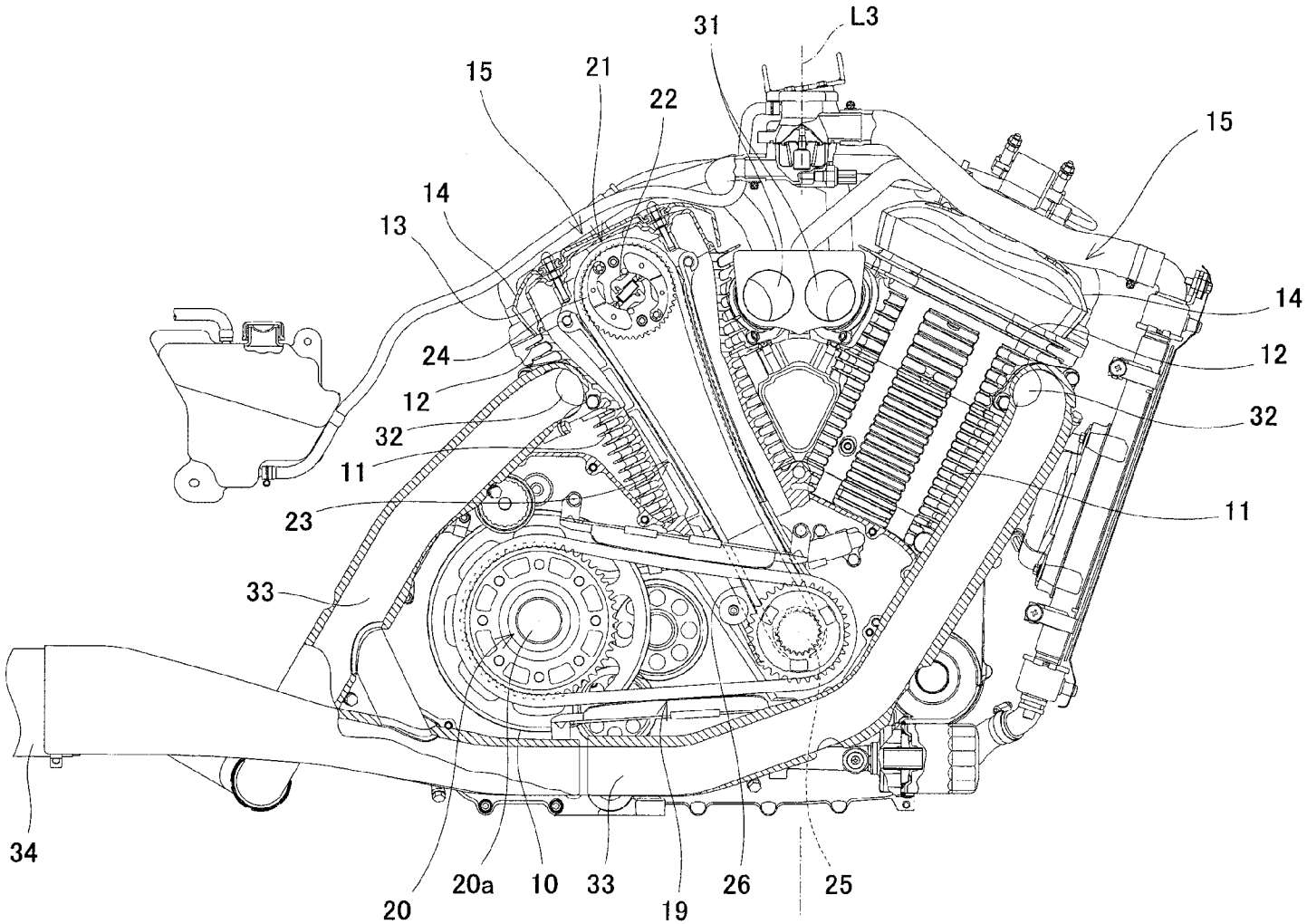
FIG. 2 is an enlarged perspective view of an engine of FIG. 1, a part of which is cut away, as viewed from a right side.

FIG. 2 is an enlarged perspective view of the engine 5 of FIG. 1, a part of which is cut away, as viewed from a right side. The engine 5 is a V-type two-cylinder four-cycle engine. The engine 5 is an example of an internal combustion engine which is configured to combust a fuel in a combustion chamber and to output a driving power. The engine 5 includes as major components, a cylinder block 11, a cylinder head 12, a cylinder head cover 13, a crankshaft 18 and a valve operating system 21. The engine 5 has a structure in which two cylinders 15 are arranged in V-shape in front and rear. The two cylinders 15 each include respective portions of the cylinder block 11, the cylinder head 12, the cylinder head cover 13 and a make-up cover 14 which are stacked on the upper surface of a crankcase 10. The two cylinders 15 have substantially the same structure and are disposed to be rotationally symmetric with respect to a rotational axis L3 extending vertically between the two cylinders 15. Hereinafter, only one of the two cylinders 15 will be described.

A piston (not shown) is slidably inserted into the cylinder block 11 within the cylinder 15. The piston is coupled to the crankshaft 18 via a connecting rod. The crankshaft 18 is accommodated in the crankcase 10 so as to extend in a rightward and leftward (lateral) direction. A right end portion of the crankshaft 18 is coupled to an input shaft 20*a* of a transmission 20 via a primary reduction gear mechanism 19. The output shaft of the transmission 20 is coupled to the rear wheel 3 via a secondary reduction gear mechanism such as a chain and a drive shaft. Thereby, the rotation of the crankshaft 18 is transmitted to the rear wheel 3 via the primary reduction gear mechanism 19, the transmission 20 and the secondary reduction gear mechanism, causing the rear wheel 3 to rotate.

A camshaft 22 of the valve operating system 21 described later is provided at the upper portion of the cylinder head 12. The camshaft 22 is provided with a through-hole 61 (see FIG. 13) extending in the axial direction thereof around the rotational axis L1 (hereinafter referred to as "cam axis L4"). The camshaft 22 extends in the lateral direction and is rotatably mounted to the cylinder head 12. The dimension of a portion of the camshaft 22 which is rotatably mounted to the cylinder head 12 is substantially equal to a sum of widths of two cams 41 described later. A driven sprocket 25 is mounted on the right end portion of the camshaft 22, while a drive sprocket 24 is mounted on the right end portion of the crankshaft 18. A timing chain 26 is installed around the drive sprocket 24 and the driven sprocket 25. In this structure, the crankshaft 18 and the camshaft 22 are rotatable in association with each other in such a manner that the camshaft 22 is rotating twice while the crankshaft 18 is rotating once.

Figure 3:
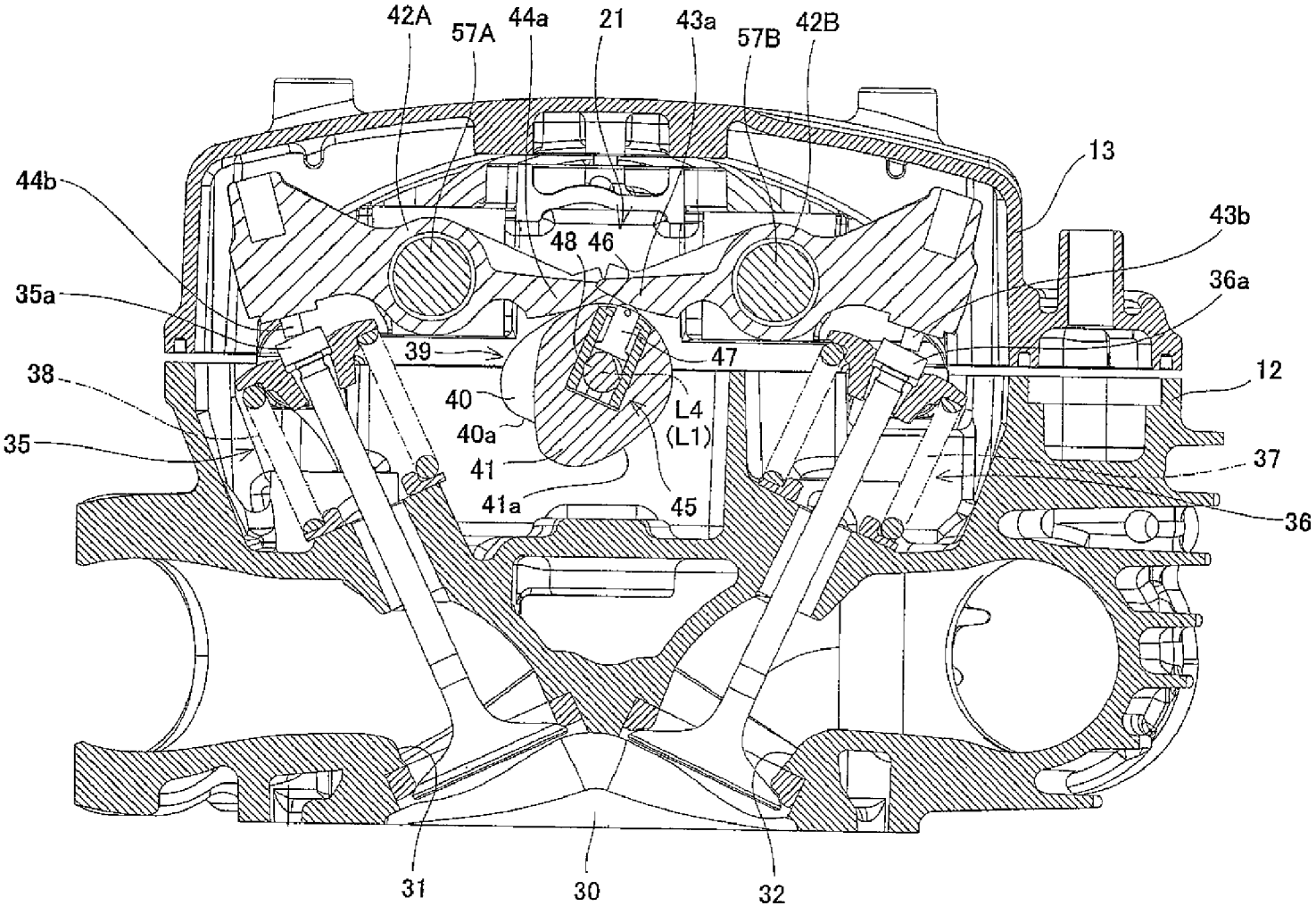
FIG. 3 is a cross-sectional view of a cylinder head taken along line III-III of FIG. 4.
Figure 4:
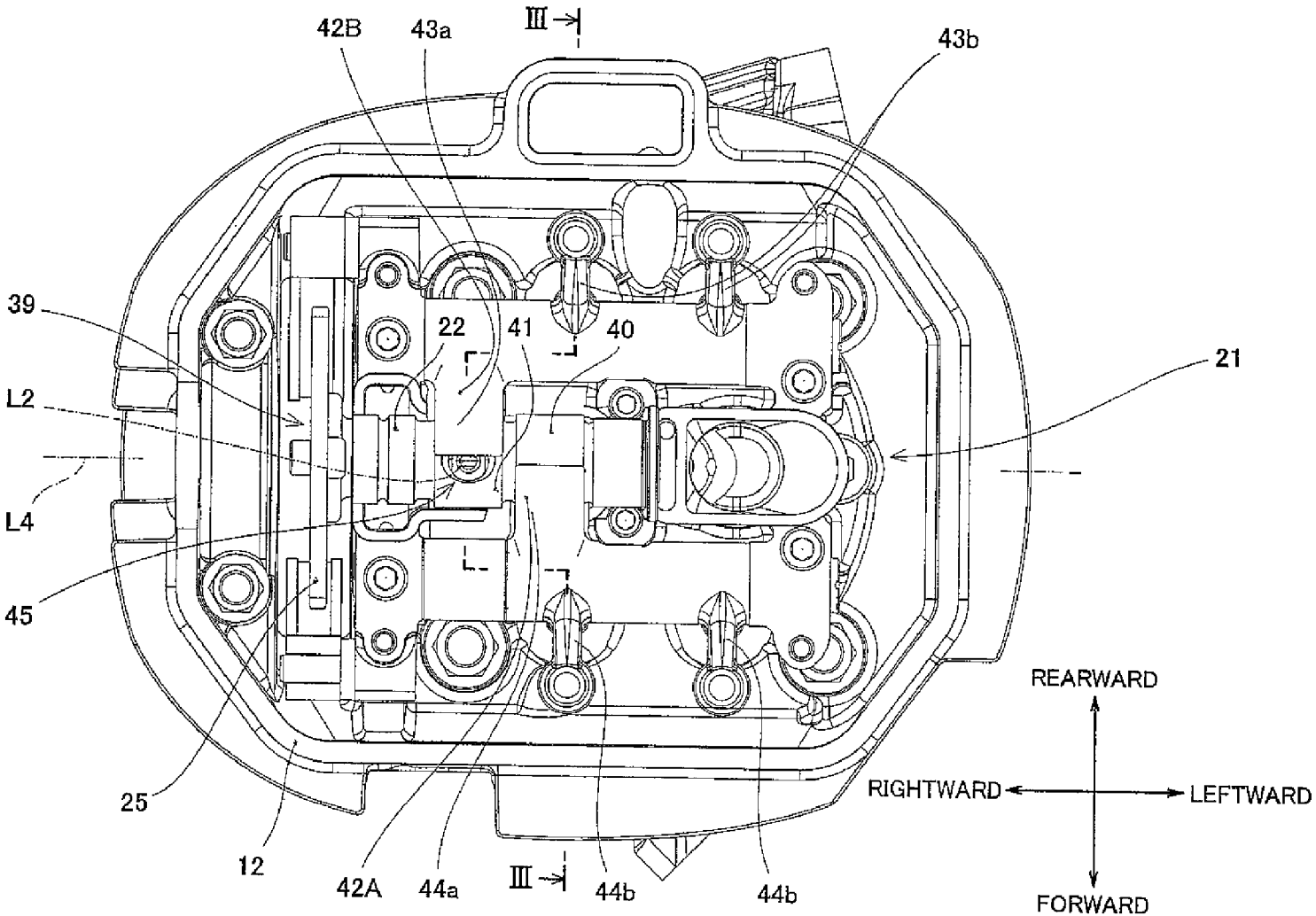
FIG. 4 is a plan view of the cylinder head in which a valve operating system is disposed, as viewed from above.

FIG. 3 is a cross-sectional view of the cylinder head 12 taken along line III-III of FIG. 4. A combustion chamber 30 is provided at the lower portion of the cylinder head 12 and is connected to a space in which the piston is accommodated. In addition, an intake port 31 and an exhaust port 32 are provided in the cylinder head 12 so as to open in the combustion chamber 30. The intake port 31 is connected to an air cleaner via an air-intake passage. The exhaust port 32 is connected to a muffler 34 (see FIG. 2) via an exhaust passage 33 (see FIG. 2). An intake valve 35 for opening and closing the intake port 31 and an exhaust valve 36 for opening and closing the exhaust port 32 are provided in the cylinder head 12. The intake valve 35 is provided with a spring member 37 for applying a force to the intake valve 35 in a direction to close the intake port 31, while the exhaust valve 36 is provided with a spring member 38 for applying a force to the exhaust valve 35 in a direction to close the exhaust port 32. Furthermore, the valve operating system 21 is provided at the upper portion of the cylinder head 12 and is configured to drive the intake valve 35 to open and close the intake port 31 and to drive the exhaust valve 36 to open and close the exhaust port 32.

[Valve Operating System]

The valve operating system 21 is a single overhead cam (SOHC) valve operating system, and includes a cam mechanism 39, an intake locker arm 42A, and an exhaust locker arm 42B. The cam mechanism 39 includes as major constituents, the camshaft 22, the driven sprocket 25, an intake cam 40 and an exhaust cam 41. The camshaft 22 is disposed between the intake valve 35 and the exhaust valve 36 which are positioned to be spaced apart from each other. The intake cam 40 and the exhaust cam 41 are integrally provided at the camshaft 22. The exhaust cam 41 is disposed at the driven sprocket 25 side. The cams 40 and 41 have a non-circular shape, which is a substantially oval shape, in cross-section perpendicular to the cam axis L4 coaxial with the camshaft 22. A circular insertion hole 41*b* is formed on the cam surface 41*a* of the exhaust cam 41. The insertion hole 41*b* is positioned on the cam surface 41*a* of the exhaust cam 41 so that its axis is closest to the cam axis L4. That is, the insertion hole 41*b* is provided in a portion of the cam surface 41*a* which the exhaust locker arm 42B contacts in the compression stroke, to be precise, when the exhaust valve 36 is in a position where the piston is at a top dead center.

The intake locker arm 42A is fastened to an intake locker shaft 57A, while the exhaust locker arm 42B is fastened to an exhaust locker shaft 57B. The intake locker shaft 57A and the exhaust locker shaft 57B are disposed to be spaced apart from each other and to extend along the cam axis L4. The locker shafts 57A and 57B are provided in the cylinder head 12 such that they are located inside the cylinder head cover 13. The locker shafts 57A and 57B are mounted to the cylinder head 12 such that they are rotatable around the cam axis L4. Therefore, the exhaust locker arm 42B is configured to be pivoted according to the rotation of the exhaust cam 41. Also, the exhaust locker arm 42B is configured to be pivoted to press down the exhaust valve 36 against the force applied by the spring member 38, thereby opening the exhaust port 32. Likewise, the intake locker arm 42A is configured to be pivoted according to the rotation of the intake cam 40. Also, the intake locker arm 42A is configured to be pivoted to press down the intake valve 35 against the force applied by the spring member 37, thereby opening the intake port 31. This configuration will be specifically described below.

FIG. 4 is a plan view of the cylinder head 12 in which the valve operating system 21 is disposed, as viewed from above. Hereinafter, description will be given with reference to FIGS. 3 and 4. A contact portion 36*a* of the exhaust valve 36 is disposed at an opposite side of the exhaust cam 41 with respect to a pivot axis of the exhaust locker arm 42B. One end portion 43*a* of the exhaust locker arm 42B is in contact with the cam surface 41*a* of the exhaust cam 41. An opposite end portion 43*b* of the exhaust locker arm 42B, which is at an opposite side of the one end portion 43*a* with respect to the pivot axis, is disposed so as to contact the contact portion 36*a* of the exhaust valve 36. Since the opposite end portion 43*b* of the exhaust locker arm 42B is configured to contact the contact portion 36*a* of the exhaust valve 36, a rotational force around the pivot axis for causing the one end portion 43*a* of the exhaust locker arm 42B to be pressed against the cam surface 41*a* of the exhaust cam 41*a* is applied to the exhaust locker arm 42B.

The exhaust cam 41 and the exhaust valve 36 are disposed in different positions in the direction along the cam axis L4. Therefore, the one end portion 43*a* and the opposite end portion 43*b* of the exhaust locker arm 42B deviate from each other in the direction along the cam axis L4. The exhaust locker arm 42B configured as described above is formed such that the width of the one end portion 43*a* along the cam axis L4 is substantially equal to the width of the exhaust cam 41.

A contact portion 35*a* of the intake valve 35 is disposed at an opposite side of the intake cam 40 with respect to a pivot axis of the intake locker arm 42A. One end portion 44*a* of the intake locker arm 42A is in contact with the cam surface 40*a* of the intake cam 40. An opposite end portion 44*b* of the intake locker arm 42A, which is at an opposite side of the one end portion 44*a* with respect to the pivot axis, is disposed so as to contact the contact portion 35*a* of the intake valve 35. Since the opposite end portion 44*b* of the intake locker arm 42A is disposed so as to contact the contact portion 36*a* of the intake valve 36, a rotational force around the pivot axis for causing the one end portion 44*a* of the intake locker arm 42A to be pressed against the cam surface 40 of the intake cam 40*a* is applied to the intake locker arm 42A. The intake cam 40 and the intake valve 35 are disposed in different positions in the direction along the cam axis L4. The one end portion 43*a* of the exhaust locker arm 42B is closer to the driven sprocket 25 than the one end portion 44*a* of the intake locker arm 42A.

In the valve operating system 21 configured as described above, the timing chain 26 causes the exhaust cam 41 to rotate in association with the crankshaft 18, causing the exhaust valve 36 to be moved, thereby opening and closing the exhaust port 32. The valve operating system 21 is configured to cause the intake valve 35 to open and close the intake port 31.

The cylinder head cover 13 is provided over the upper end portion of the cylinder head 12 so as to cover the valve operating system 21 configured as described above, and the make-up cover 14 is provided to cover the cylinder head cover 13.

In the cruiser-type motorcycle 1 of this embodiment, the volume per cylinder of the engine 5 is larger than that of another motorcycle such as a sport-type motorcycle. For this reason, the engine 5 is capable of outputting a relatively large torque in a low-speed range. But, the torque required to compress an air-fuel mixture in the interior of the combustion chamber 30 at the start of the engine 5 is large. Accordingly, the valve operating system 21 is provided with a decompression mechanism 45 to reduce the torque required to compress the air-fuel mixture at the start the engine 5.

[Decompression Mechanism]

Figure 5:
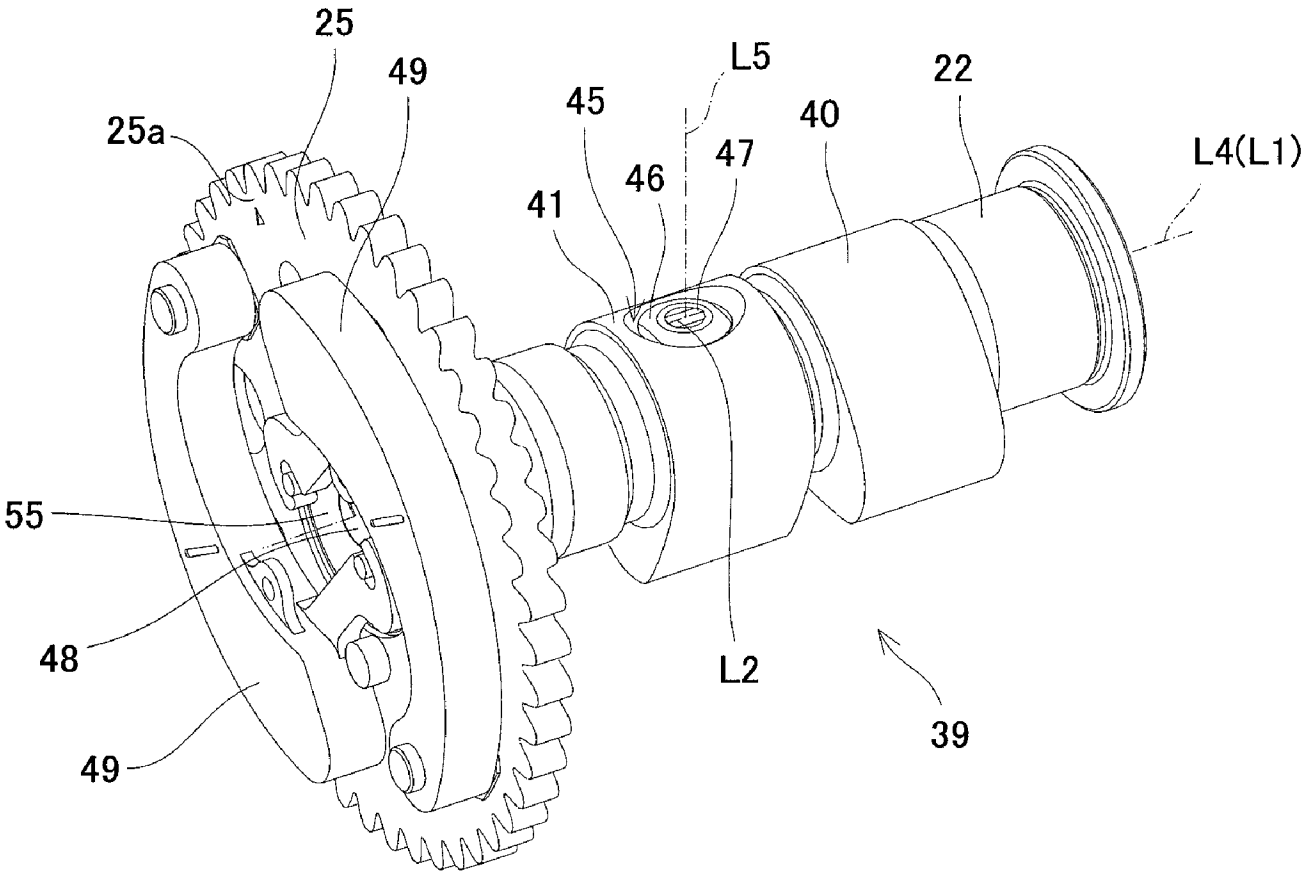
FIG. 5 is a perspective view of a cam mechanism including a decompression mechanism.
Figure 6:
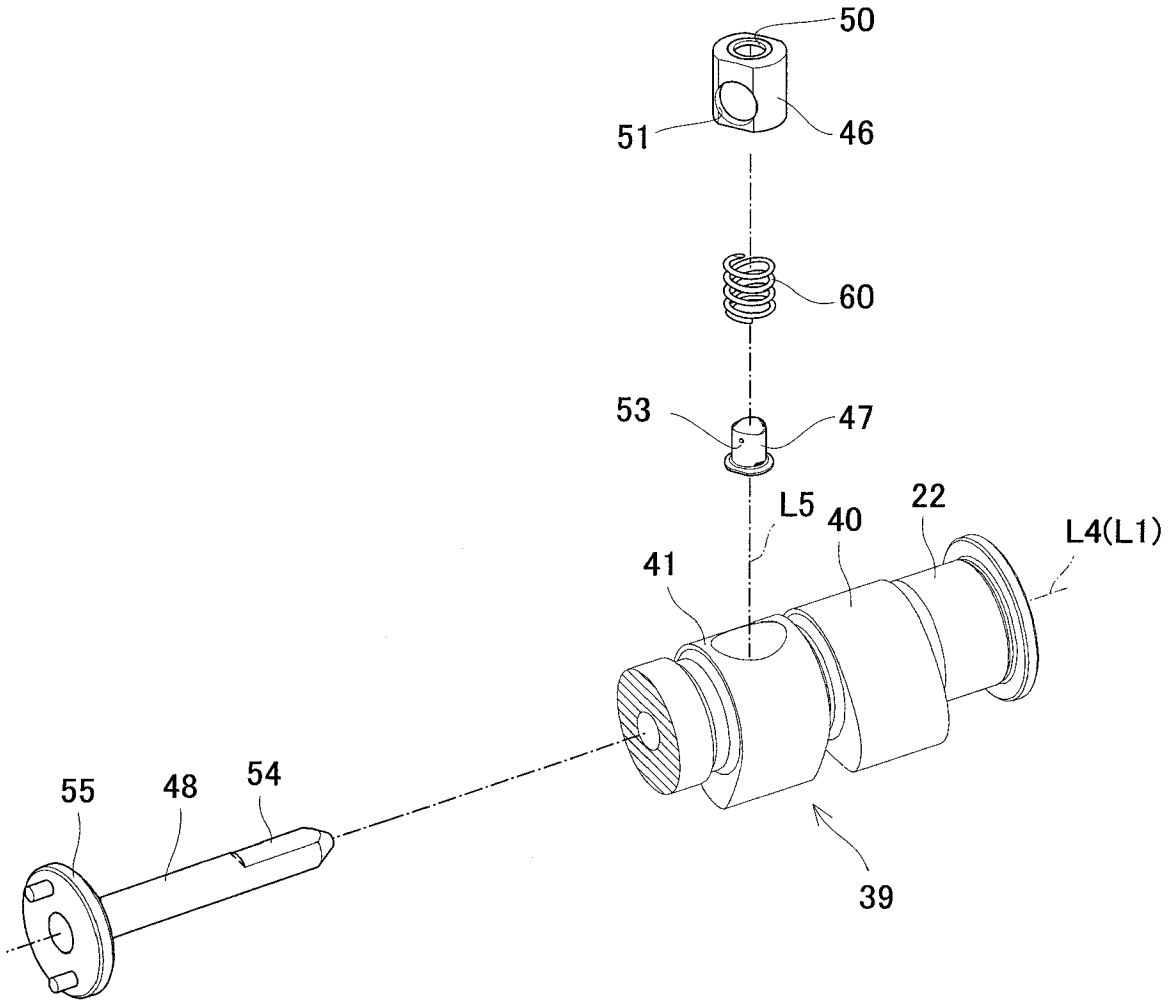
FIG. 6 is an exploded perspective view of the cam mechanism.

FIG. 5 is a perspective view of a cam mechanism 39 including the decompression mechanism 45. FIG. 6 is an exploded perspective view of the decompression mechanism 45. In FIG. 6, a part of the cam mechanism 39 is omitted. The decompression mechanism 45 is provided in the cam mechanism 39. The decompression mechanism 45 includes as major constituents, a sleeve 46, a decompression pin 47, a decompression shaft 48, two weight members 49 and a biasing member 60.

Figure 7:
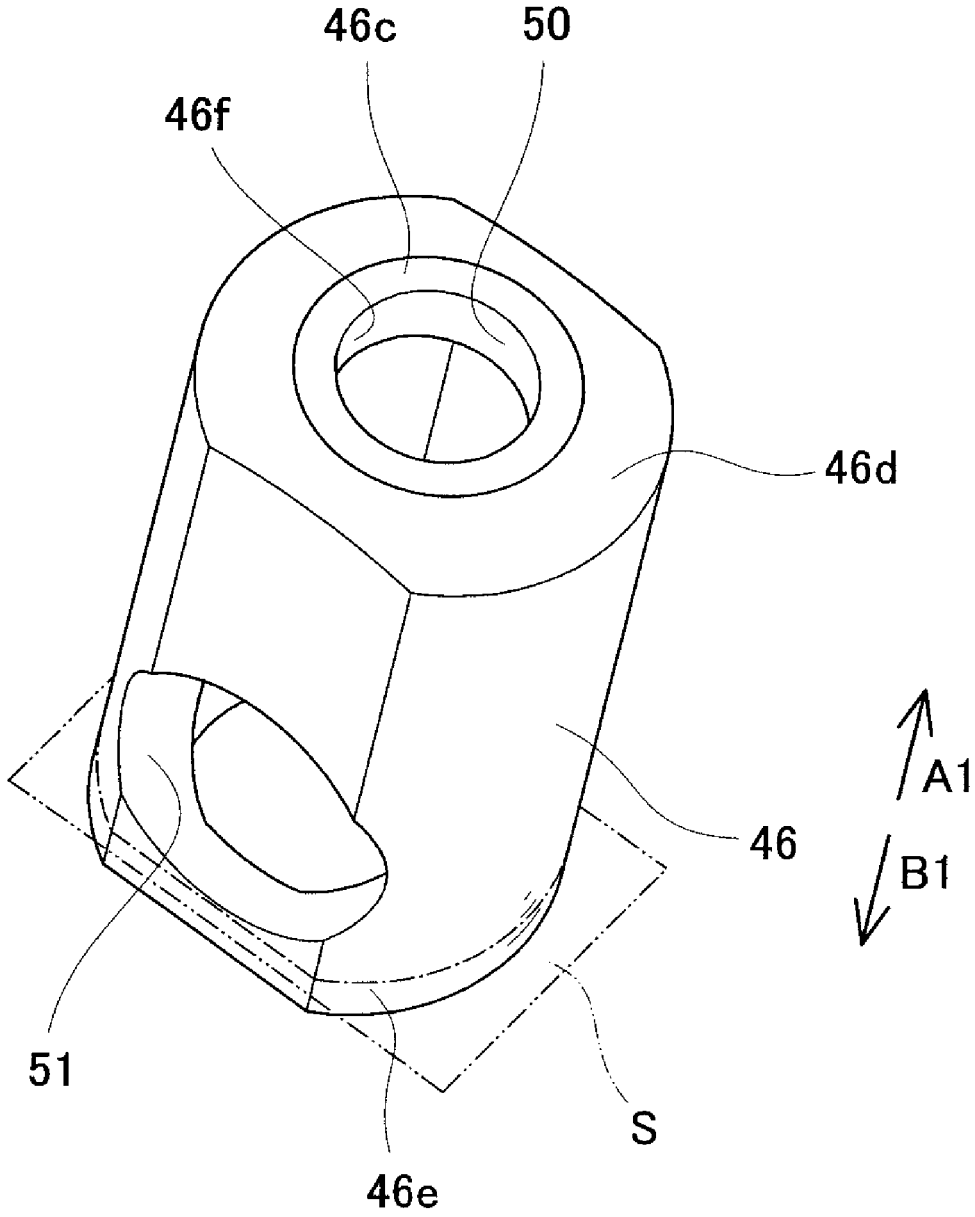
FIG. 7 is a perspective view of a sleeve.
Figure 8:
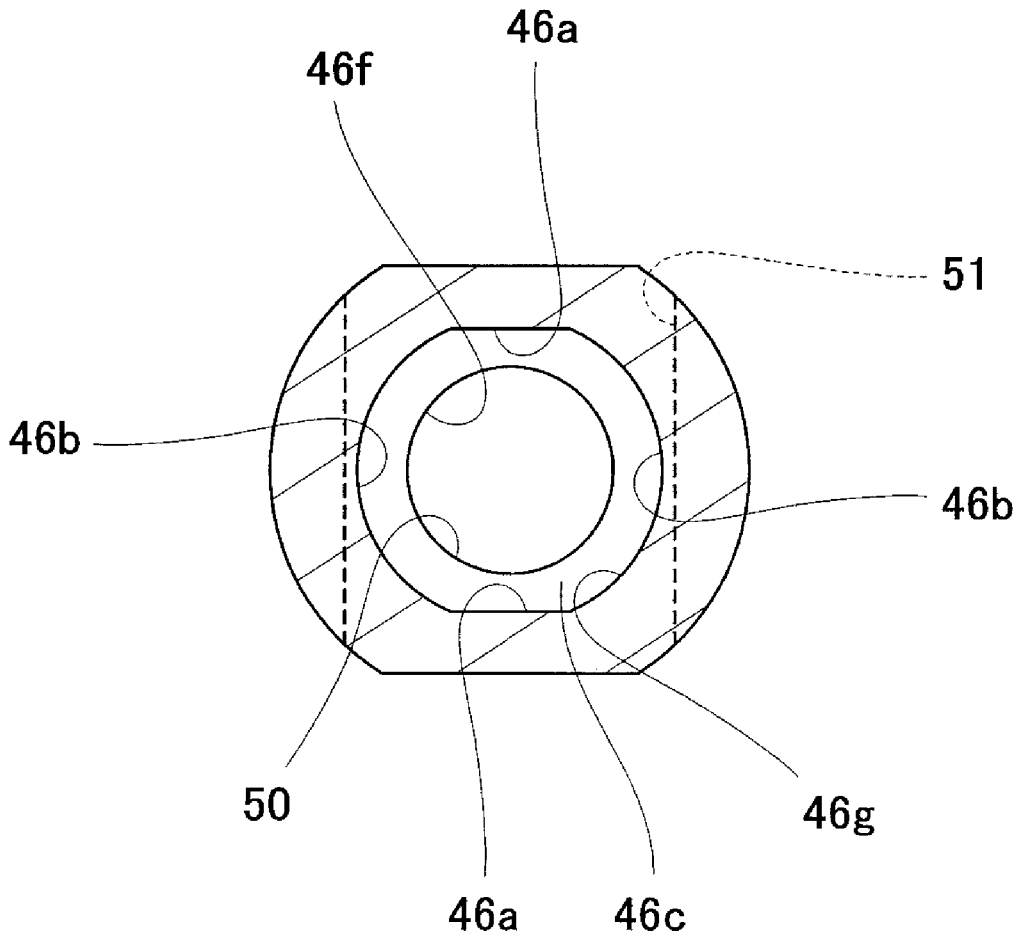
FIG. 8 is a cross-sectional view of the sleeve of FIG. 7, which is taken in a direction perpendicular to its axial direction.

FIG. 7 is a perspective view of the sleeve 46. FIG. 8 is a cross-sectional view of the sleeve 46 of FIG. 7, taken along an imaginary plane S. The sleeve 46, which is an accommodating member, has a tubular shape which forms an inner space and opens at axial end portions thereof. In this embodiment, the sleeve 46 has a substantially cylindrical shape. The sleeve 46 has an inner peripheral surface having a substantially oval shape as viewed from above. The sleeve 46 has two flat portions 46*a* which are parallel to each other at opposite positions and two circular-arc portions 46*b* at opposite positions, as viewed from above. The sleeve 46 has an outer peripheral surface having a substantially oval shape as viewed from above.

The sleeve 46 has an inward flange 46*c* at an opening end portion 46*d* located at an end in an axial one direction indicated by an arrow A1. The inward flange 46*c* extends over an entire circumference so as to protrude radially inward. Because of the presence of the inward flange 46*c*, a substantially circular protruding hole 50 is formed at the opening end portion 46*d* of the sleeve 46. A circular insertion hole 51 is formed at an end portion 46*e* of the sleeve 46 in an axial opposite direction indicated by an arrow B1, so as to extend in the direction which is orthogonal to the axial one direction A1 and the axial opposite direction B1, and is perpendicular to the flat portions 46*a*.

Figure 9:
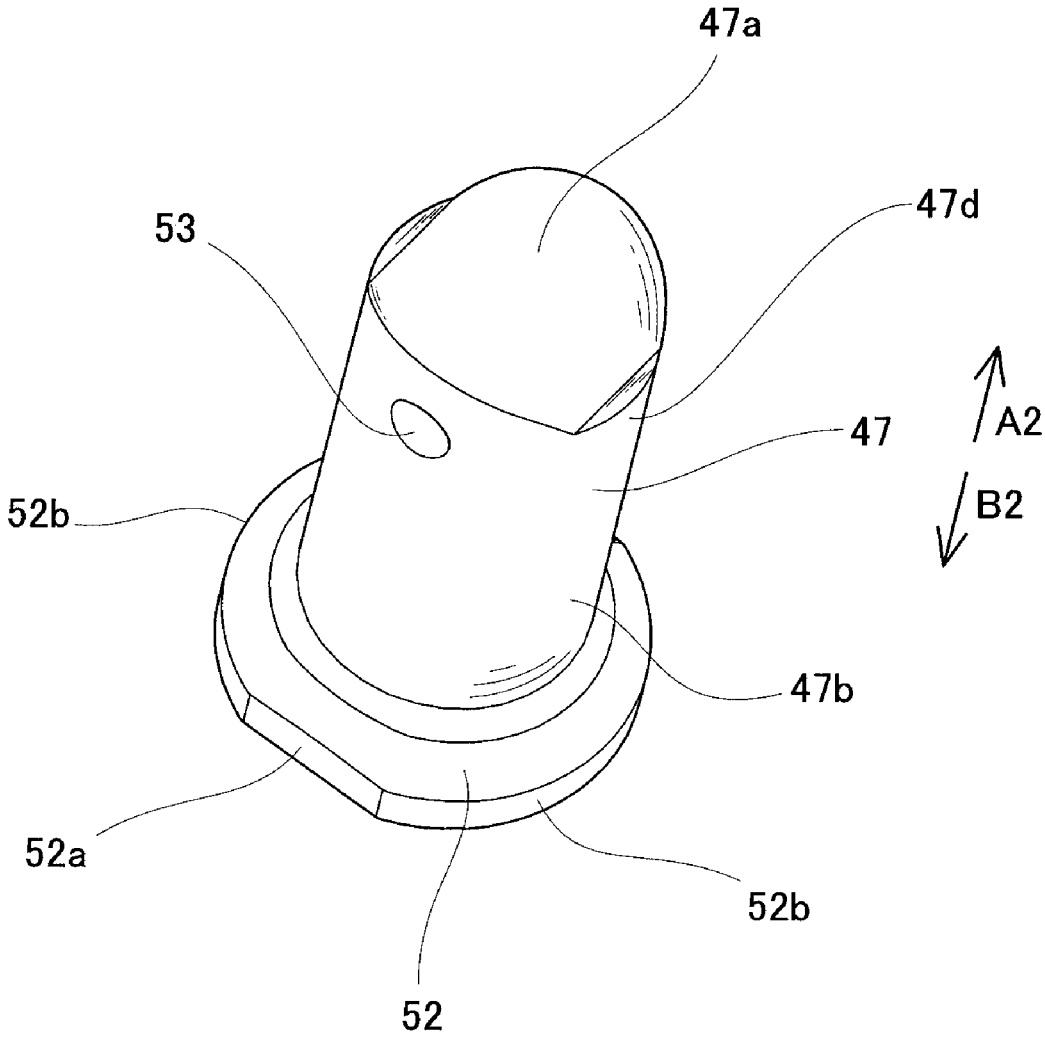
FIG. 9 is a perspective view of a decompression pin.
Figure 10:
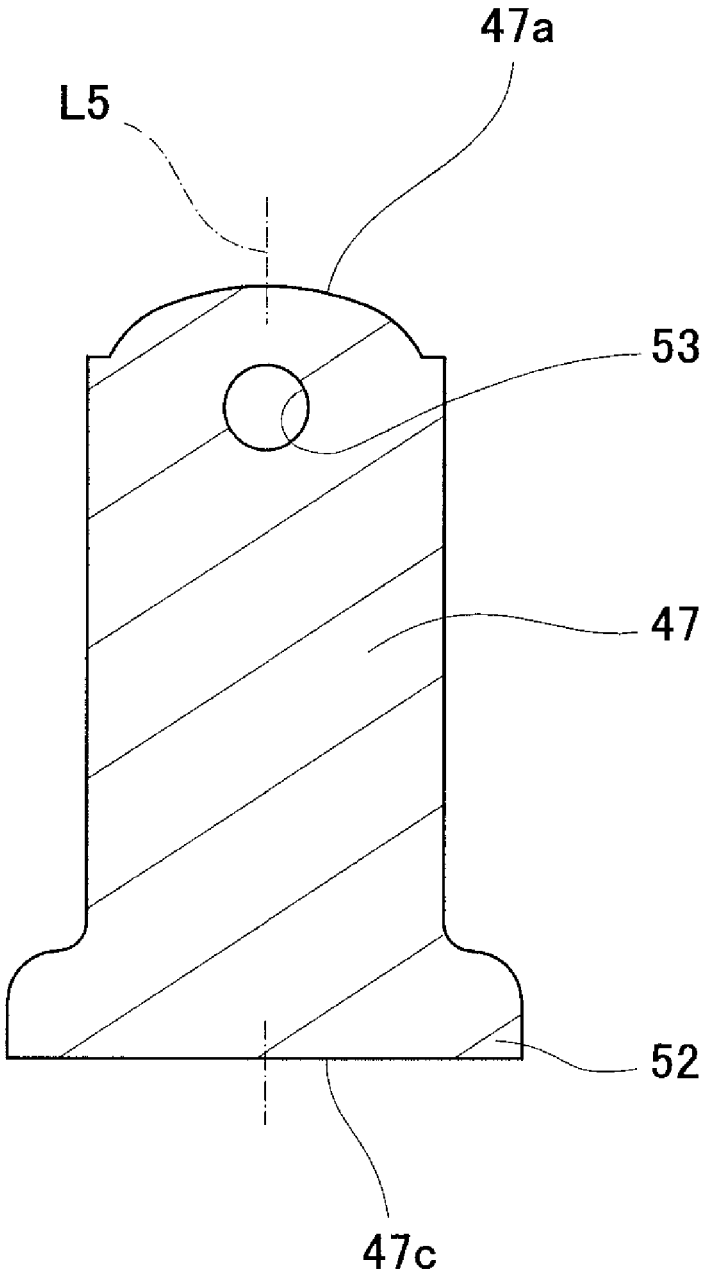
FIG. 10 is a front view of the decompression pin of FIG. 9.

FIG. 9 is a perspective view of the decompression pin 47. FIG. 10 is a front view of the decompression pin 47. The decompression pin 47 which is a decompression member has a substantially cylindrical shape. The decompression pin 47 has an outward flange 52 at one end portion thereof in an axial one direction indicated by an arrow B2. The outward flange 52 extends over an entire circumference of the decompression pin 47 so as to protrude radially outward. The cross-section perpendicular to the axis of the outer peripheral surface of the outward flange 52 has a substantially oval shape substantially conforming to the cross-sectional shape of the inner peripheral surface of the sleeve 46. That is, the outer peripheral surface of the outward flange 52 has two flat portions 52*a* which are parallel to each other at opposite positions and two circular-arc portions 52*b* at opposite positions. In such a structure, the decompression pin 47 is extendable and retractable in the axial one direction A1 and the axial opposite direction B1 within the sleeve 46, and is inhibited from rotating around the axis L5 of the decompression pin 47 with respect to the sleeve 46. In a state where the decompression pin 47 is accommodated in the sleeve 46, the outward flange 52 of the decompression pin 47 engages with the inward flange 46*c* of the sleeve 46, so that the decompression pin 47 is inhibited from coming off in the axial one direction A1 from the protruding hole 50 of the sleeve 46.

Except for a portion corresponding to the outward flange 52, the outer peripheral surface 47*b* of the decompression pin 47 has a circular cross-section so as to conform in shape to the inner peripheral surface 46*f* (see FIGS. 7 and 8) of the inward flange 46*c* of the sleeve 46. Thereby, a space for accommodating a biasing member 60 is formed between the outer peripheral surface 47*b* of the decompression pin 47 and the inner peripheral surface 46*b* of the sleeve 46. An end surface 47*c* of the decompression pin 47 in the axial one direction B2, i.e., a rear surface of the outward flange 52, is formed to be flat.

An opposite end portion 47*d* of the decompression pin 47 which is in an axial opposite direction indicated by an arrow A2 has an arch-shaped contact surface 47*a* which is curved to protrude in the axial opposite direction A2 in the cross-section parallel to the axial direction. In this embodiment, in a state where the decompression pin 47 is inserted into the sleeve 46, the cross-section perpendicular to the axis of the insertion hole 51 is evenly arch-shaped in any position along the axis of the insertion hole 51. In other words, the contact surface 47*a* which is the tip end surface of the decompression pin 47 has a partially cylindrical shape in which the contact surface 47*a* protrudes in the axial opposite direction A2 of the decompression pin 47 and extends along the axis of the insertion hole 51, in the state where the decompression pin 47 is inserted into the sleeve 46.

An assembly hole 53 is formed in the opposite end portion 47*d* of the decompression pin 47 so as to penetrate in the direction perpendicular to the axis of the decompression pin 47, i.e., radial direction of the decompression pin 47 and the direction perpendicular to the flat portions 52*a*. In more detail, the assembly hole 53 is exposed outside the protruding hole 50 when the outward flange 52 of the decompression pin 47 is disposed closer to the end of the sleeve 46 in the axial one direction A1 than the insertion hole 51 in the state where the decompression pin 47 is inserted into the sleeve 46.

Figure 11:
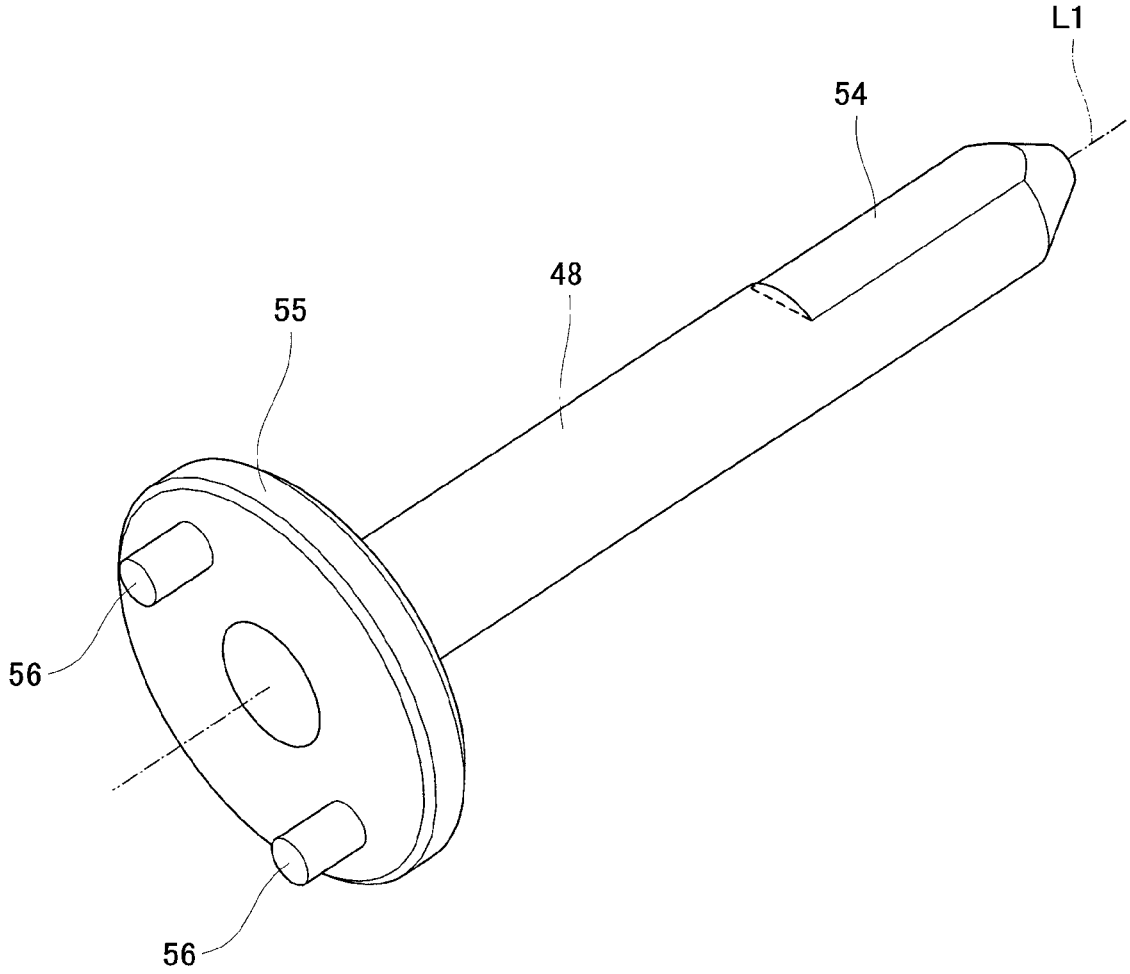
FIG. 11 is a perspective view of a decompression shaft.

FIG. 11 is a perspective view of the decompression shaft 48. The decompression shaft 48 has a substantially cylindrical shape. The decompression shaft 48 which is an insertion member has an outer diameter which is substantially equal to the hole diameter of the insertion hole 51. The decompression shaft 48 is partially cut away in the circumferential direction thereof from a tip end portion thereof to an intermediate portion thereof, forming a flat portion 54. The flat portion 54 forms a flat surface parallel to the axis of the decompression shaft 48. The flat portion 54 is formed by cutting away the outer peripheral surface of the decompression shaft 48 in a range of an angle θ (see FIG. 14) around the axis L1. The angle θ is preferably not smaller than 40 degrees and not larger than 50 degrees. By setting the angle θ to 50 degrees or smaller, it is possible to avoid that the sleeve 46 is unstably fixed by the decompression shaft 48.

A drive control plate 55 is provided at a base end portion of the decompression shaft 48. The drive control plate 55 has a substantially disc shape. The outer diameter of the drive control plate 55 is set larger than the outer diameter of the decompression shaft 48. The axis of the drive control plate 55 conforms to the axis L1 of the decompression shaft 48. Two protruding members 56 are provided on a surface of the drive control plate 55 which is at the opposite side of the decompression shaft 48, in positions which are rotationally symmetric with respect to the axis L1.

Figure 12:
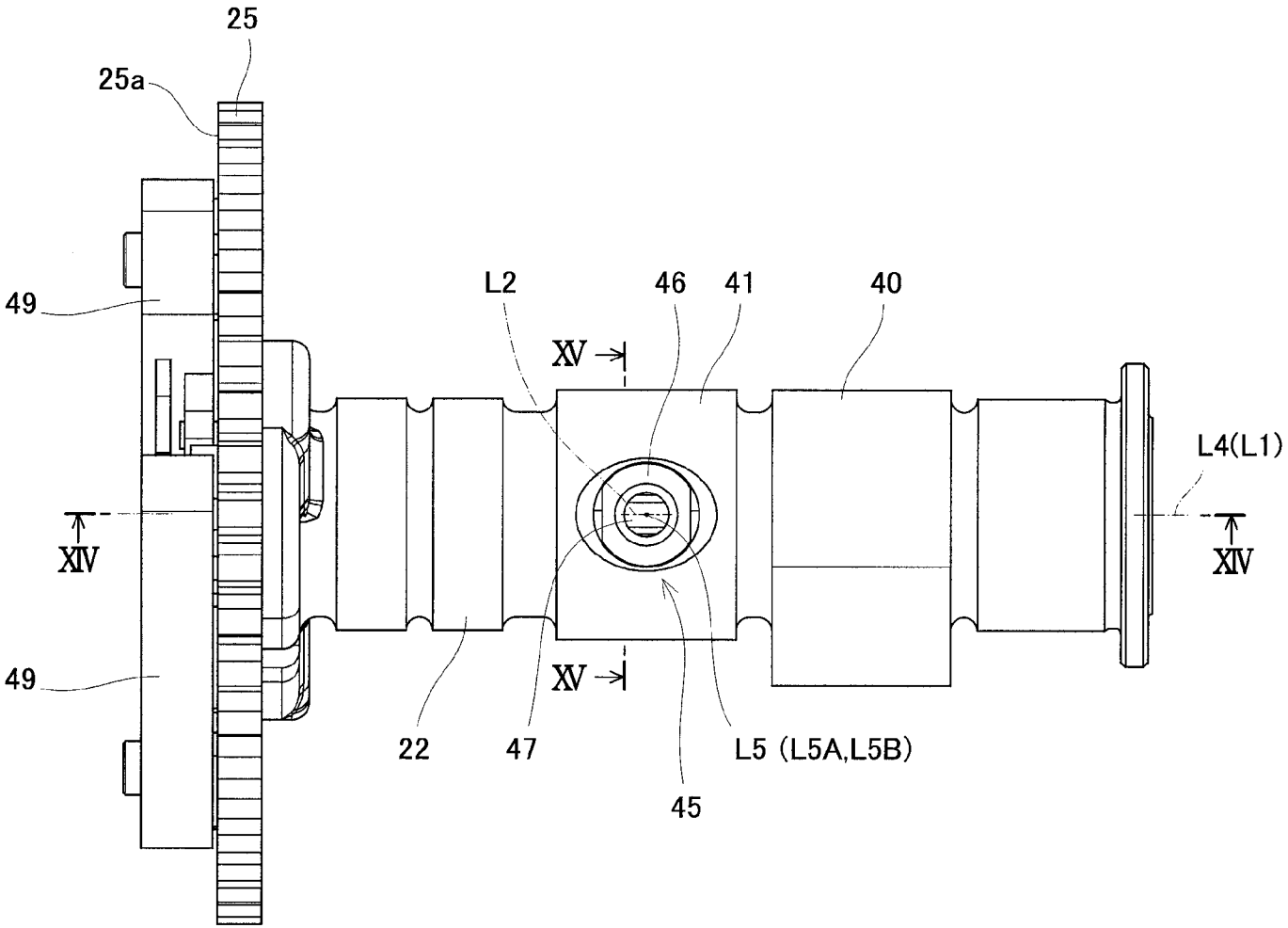
FIG. 12 is a plan view of a cam mechanism of FIG. 5 as viewed from above.
Figure 13:
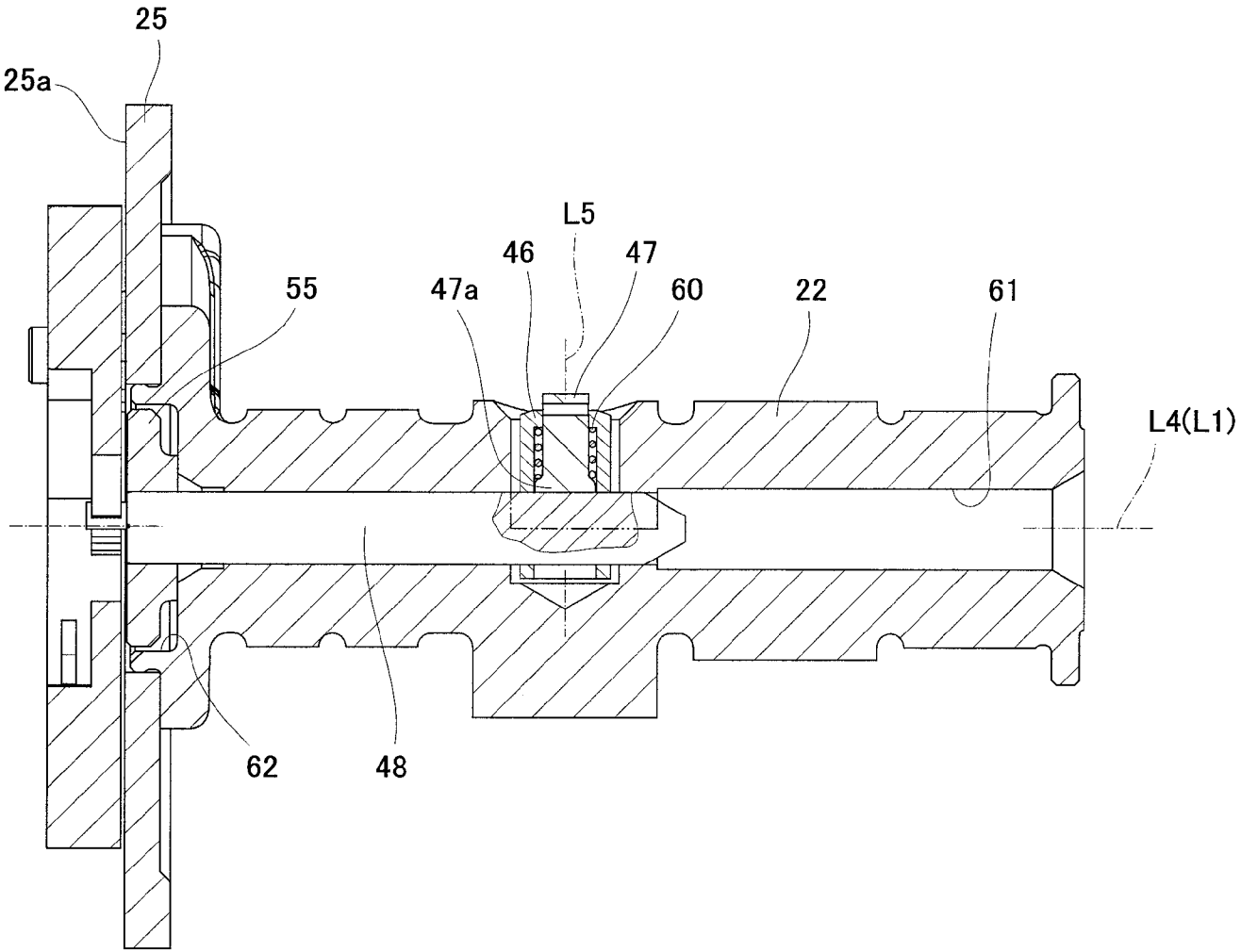
FIG. 13 is a front cross-sectional view of the cam mechanism taken along line XIV-XIV of FIG. 12.
Figure 14:
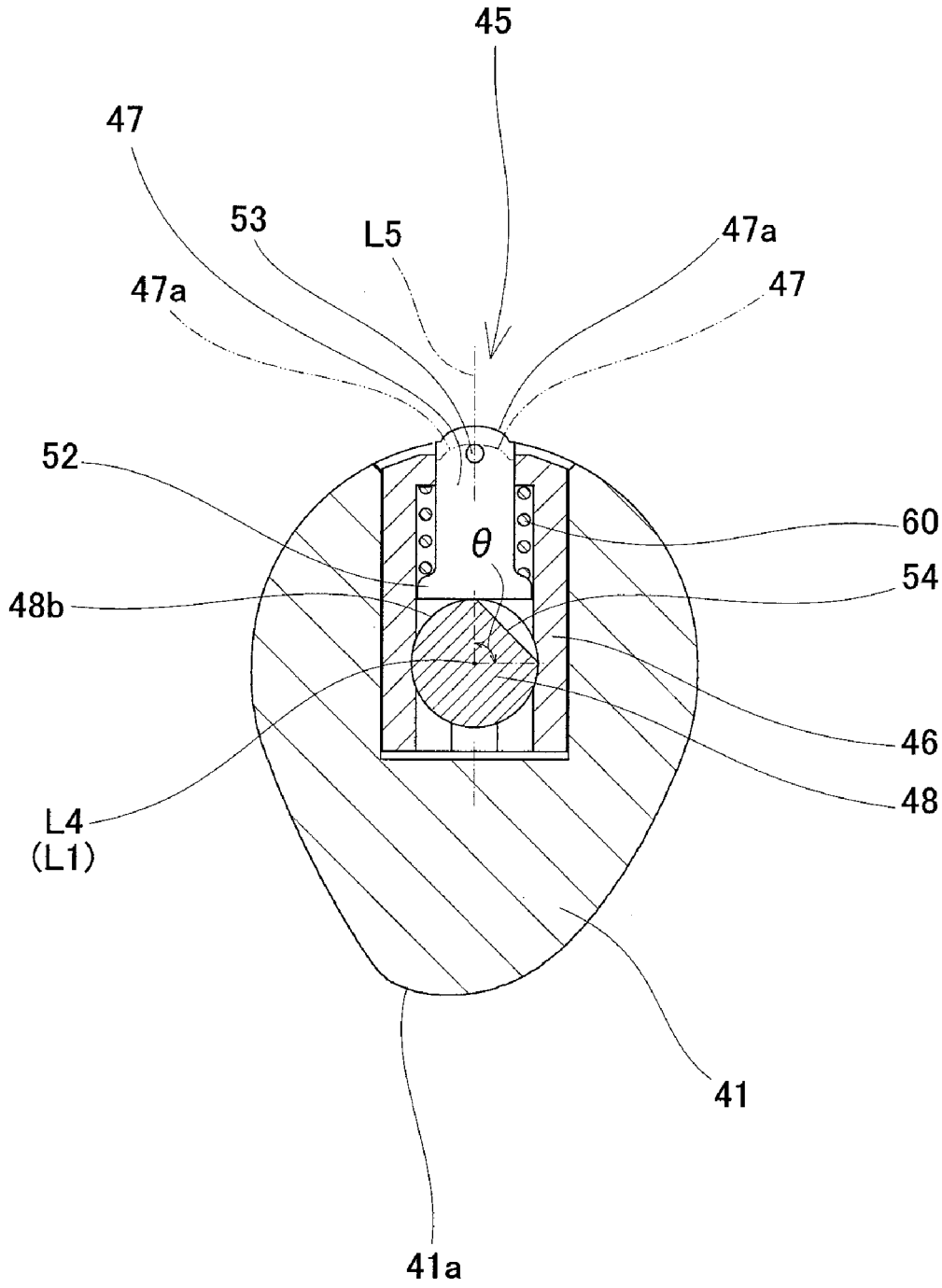
FIG. 14 is a right side cross-sectional view of the cam mechanism taken along line XV-XV of FIG. 12.

FIG. 12 is a plan view of the cam mechanism 39 of FIG. 5. FIG. 13 is a front cross-sectional view of the cam mechanism 39 taken along line XIV-XIV of FIG. 12. FIG. 14 is a right side cross-sectional view of the cam mechanism 39 taken along line XV-XV of FIG. 12. The decompression pin 47 is inserted into the sleeve 46. The biasing member 60 which is a compressive spring as shown in FIG. 13 is accommodated between the outward flange 52 of the decompression pin 47 and the inward flange 46*c* of the sleeve 46. The biasing member 60 applies a force to the decompression pin 47 radially inward of the camshaft 22. The outward flange 52 of the decompression pin 47 is disposed closer to the end of the sleeve 46 in the axial one direction A1 than the insertion hole 51, i.e., radially outward of the camshaft 22.

The sleeve 46 is inserted into the insertion hole 41*b* such that the opening end portion which is at the opposite side of the opening end portion where the protruding hole 50 is located is first inserted into the insertion hole 41*b*. The sleeve 46 is configured to be positioned so that the sleeve 61 does not protrude out from the insertion hole 41*b* and the through-hole 61 is connected to the insertion hole 51. Thereby, an edge line L2 of the contact surface 47*a* of the decompression pin 47 is parallel to the cam axis L4 of the camshaft 22.

The decompression shaft 48 is inserted into the through-hole 61 of the camshaft 22 from the side of the driven sprocket 25 through the insertion hole 51 of the sleeve 46 such that the decompression shaft 48 is rotatable. Thus, the sleeve 46 is positioned and fixed within the insertion hole 41*b*. The base end portion of the decompression pin 47 is supported by the decompression shaft 48 against a force applied by the biasing member 60. The axis L1 of the decompression shaft 48 substantially conforms to the cam axis L1 of the camshaft 22.

The flat portion 54 of the decompression shaft 48 is inserted into the insertion hole 51 of the sleeve 46. Therefore, by rotating the decompression shaft 48 around the axis L1 so as to change the relative attitudes of the decompression shaft 48 and the base end portion of the decompression pin 47, the amount of the decompression pin 47 protruding from the cam surface 41*a* is adjustable.

Figure 15A:
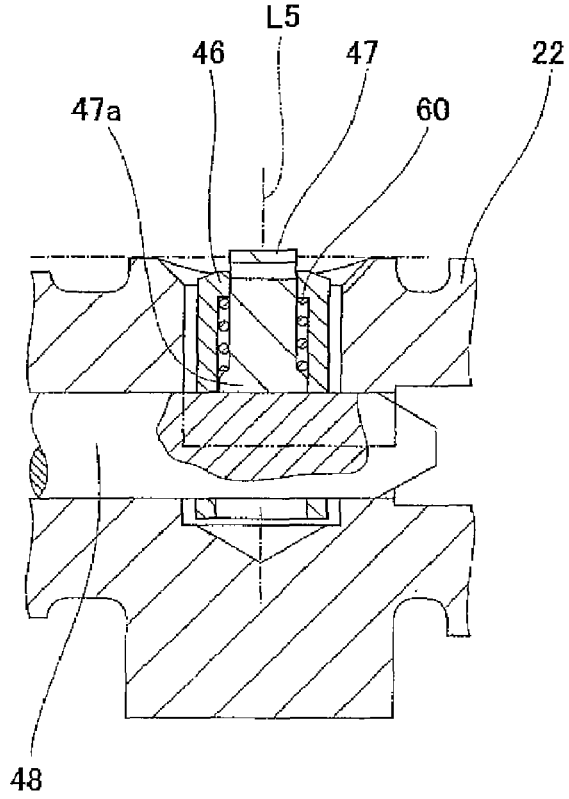
FIG. 15A is a partial cross-sectional view showing a state where the decompression pin is accommodated into a sleeve.
Figure 15B:
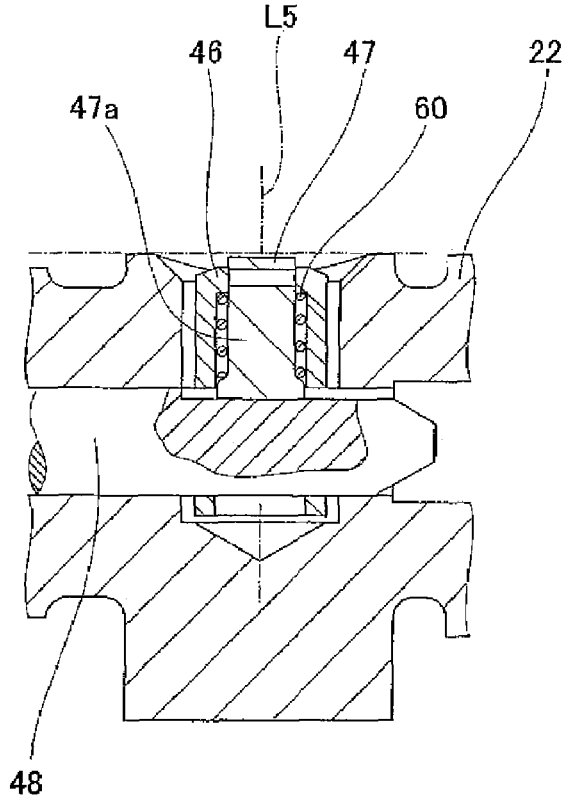
FIG. 15B is a partial cross-sectional view showing a state where a part of the decompression pin protrudes from the sleeve.

FIG. 15A is a partial cross-sectional view showing a state where the decompression pin 47 is accommodated into the sleeve 46. FIG. 15B is a partial cross-sectional view showing a state where a part of the decompression pin 47 protrudes from the sleeve 46. To be specific, in a state where the flange 52 of the decompression pin 47 is in contact with the flat portion 54 of the decompression shaft 48, the contact surface 47*a* of the decompression pin 47 is located radially inward relative to the cam surface 41*a* (see FIG. 15A). Under the condition, by rotating the decompression shaft 48 around the axis L1, the decompression pin 47 is pressed up, so that the contact surface 47*a* protrudes radially outward relative to the cam surface 41*a* (see FIG. 15B). The protruding amount of the contact surface 47*a* reaches a maximum amount at the time point when the base end portion of the decompression pin 47 is placed on the circular-arc portion 48*b* of the decompression shaft 48. When the outer diameter of the circular-arc portion 48*b* is changed, the protruding amount of the contact surface 47*a* is changed. Therefore, by adjusting the outer diameter of the circular-arc portion 48*b*, the protruding amount of the contact surface 47*a* is adjustable.

A recess 62 is formed on the opening end portion of the camshaft 22 at the driven sprocket 25 side so as to enclose the through-hole 61. The drive control plate 55 provided at the decompression shaft 48 is accommodated in the recess 62. The surface of the drive control plate 55 at the protruding member 56 side is coplanar with a weight forming surface 25*a* of the driven sprocket 25 which is at an opposite side of the surface thereof facing the exhaust cam 41. Two weight members 49 are provided on the weight forming surface 25*a*.

Figure 16:
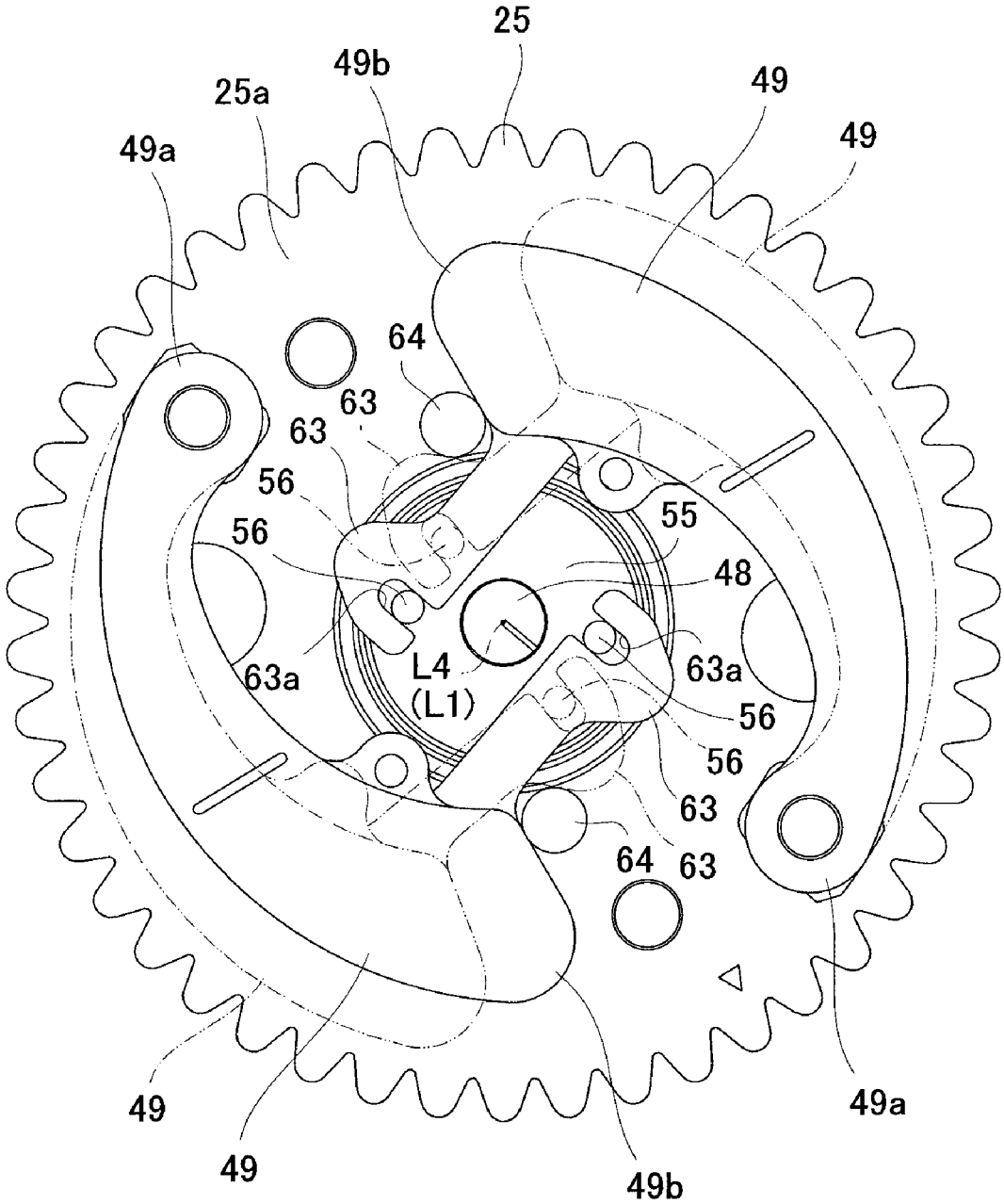
FIG. 16 is a left side view of the cam mechanism of FIG. 5.

FIG. 16 is a left side view of the cam mechanism 39 of FIG. 5. Each weight member 49 has a substantially circular-arc shape. The two weight members 49 are disposed along the outer periphery of the weight forming surface 25*a*. The two weight members 49 are positioned rotationally symmetric with respect to the cam axis L4 of the camshaft 22. Each weight member 49 is pivotally mounted at one end portion 49*a* thereof to the driven sprocket 25. An engagement member 63 is provided at an opposite end portion 49*b* of each weight member 49. An engagement groove 63*a* is formed on a tip end portion of the engagement member 63. The protruding member 56 of the drive control plate 55 engages with the engagement groove 63*a*. When the weight member 49 is pivoted, the engagement member 63 causes the protruding member 56 to rotate around the axis L1, causing the drive control plate 55 to rotate. That is, the weight member 49 and the engagement member 63 are configured to cause the drive control plate 55 to rotate.

Two stopper members 64 are respectively disposed on the weight forming surface 25*a* in the vicinity of the recess 62. The two stopper members 64 are disposed rotationally symmetric with respect to the cam axis L4 of the camshaft 22. Each stopper member 64 is configured to contact the weight member 49 and the engagement member 63. Each stopper member 64 is disposed to restrict a pivot movement range of each weight member 49 to a certain range. Extension members 65 which are extension coil springs are provided at the two weight members 49 in positions which are rotationally symmetric with respect to the cam axis L4. The extension members 65 causes the two weight members 49 to be pulled radially inward and to be in contact with the stopper members 64.

Figure 17A:
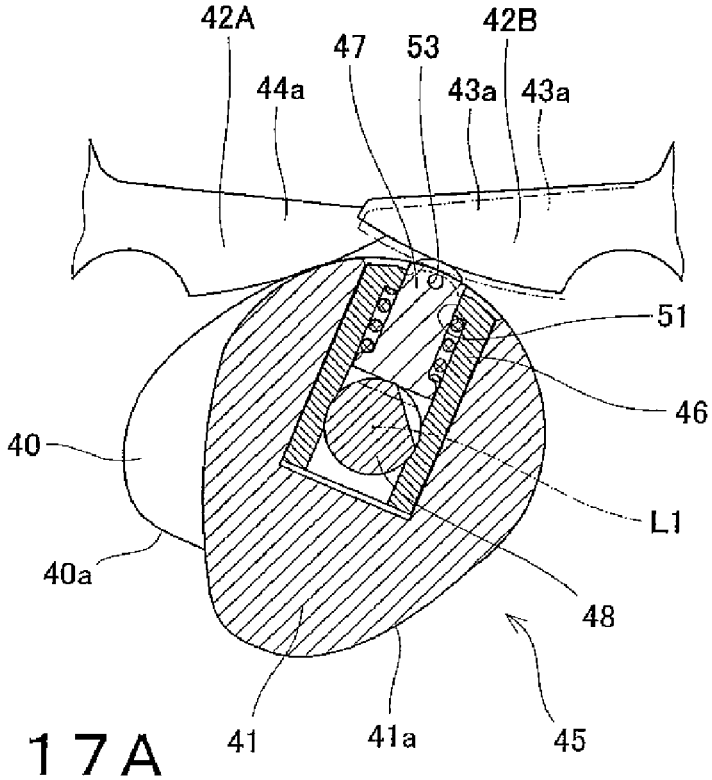
FIG. 17A is a view showing a region surrounding the cam mechanism and FIG. 17B is a view showing a region surrounding an exhaust port.
Figure 17B:
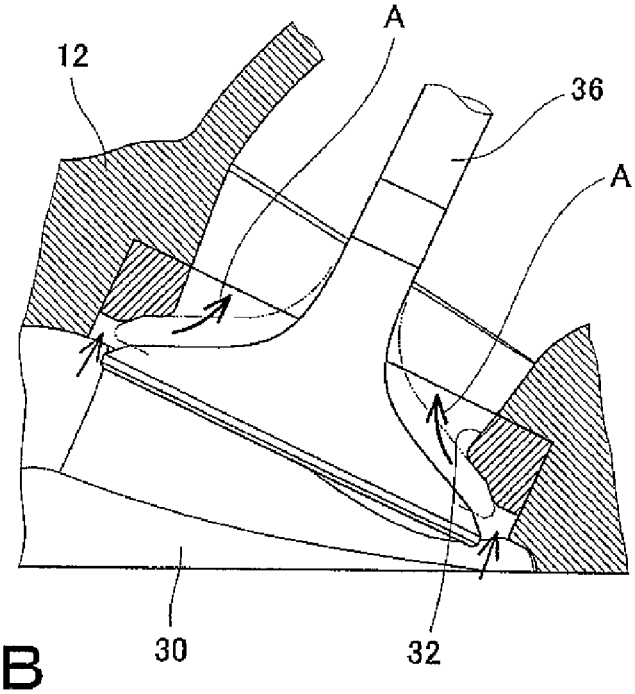

FIG. 17A is a partial cross-sectional view showing a region surrounding the cam mechanism 39 of the engine 5 of FIG. 3. FIG. 17B is a partial cross-sectional view showing a region surrounding the exhaust port 32 of the engine 5 of FIG. 3. The state where the weight member 49 is in contact with the stopper member 64 is the state where the engine 5 is starting. In this state, the base end portion of the decompression pin 47 is supported on the circular-arc portion 48*b* of the decompression shaft 48. Therefore, the contact surface 47*a* of the decompression pin 47 protrudes from the cam surface 41*a* of the exhaust cam 41. Under this condition, when the exhaust cam 41 rotates and the contact surface 47*a* is brought into contact with the exhaust locker arm 42B, the exhaust valve 36 is slightly pressed down. The decompression pin 47 is configured to contact the exhaust locker arm 42B when the exhaust valve 36 is in a position where the piston is at the top dead center, i.e., in the compression stroke. For this reason, in the state where the decompression pin 47 is protruding, the exhaust port 32 is not fully closed and is slightly open even in the compression stroke. This makes it possible to release the air-fuel mixture from the interior of the combustion chamber 30 through the exhaust port 32 in the compression stroke (see arrow A of FIG. 17B) to reduce the pressure of the combustion chamber 30. That is, the torque required to compress the air-fuel mixture in the combustion chamber 30 at the start of the engine 5 can be reduced.

After the engine 5 starts, the crankshaft 18 rotates, and the camshaft 22 rotates in association with the crankshaft 18. The weight member 49 is pivoted radially outward as indicated by two-dotted lines of FIG. 17 due to a centrifugal force, causing the drive control plate 55 to rotate clockwise in FIG. 17. Thereby, the base end portion of the decompression pin 47 which was placed on the circular-arc portion 48*b* of the decompression shaft 48 is moved to be placed on the flat portion 54 of the decompression shaft 48 and the contact surface 47*a* of the decompression pin 47 is retracted radially inward. When the base end portion of the decompression pin 47 becomes parallel to the flat portion 54 of the decompression shaft 48, the engagement member 63 contacts the stopper member 64, restricting the pivot movement of the weight member 49. In this state, the contact surface 47*a* of the decompression pin 47 is located radially inward relative to the cam surface 41*a* (see the two-dotted lines in FIG. 17A), so that the exhaust valve 36 is fully closed in the compression stroke (see two-dotted line of FIG. 17(B)).

When the engine 5 stops and the camshaft 22 stops rotating, the two weight members 49 are pulled radially inward by the extension members 65 such that weight member 49 is pivoted to contact the stopper member 64. Thereby, the decompression pin 47 is extended again and the contact surface 47*a* protrudes from the cam surface 41*a*.

[Assembly Process]

Figure 18:
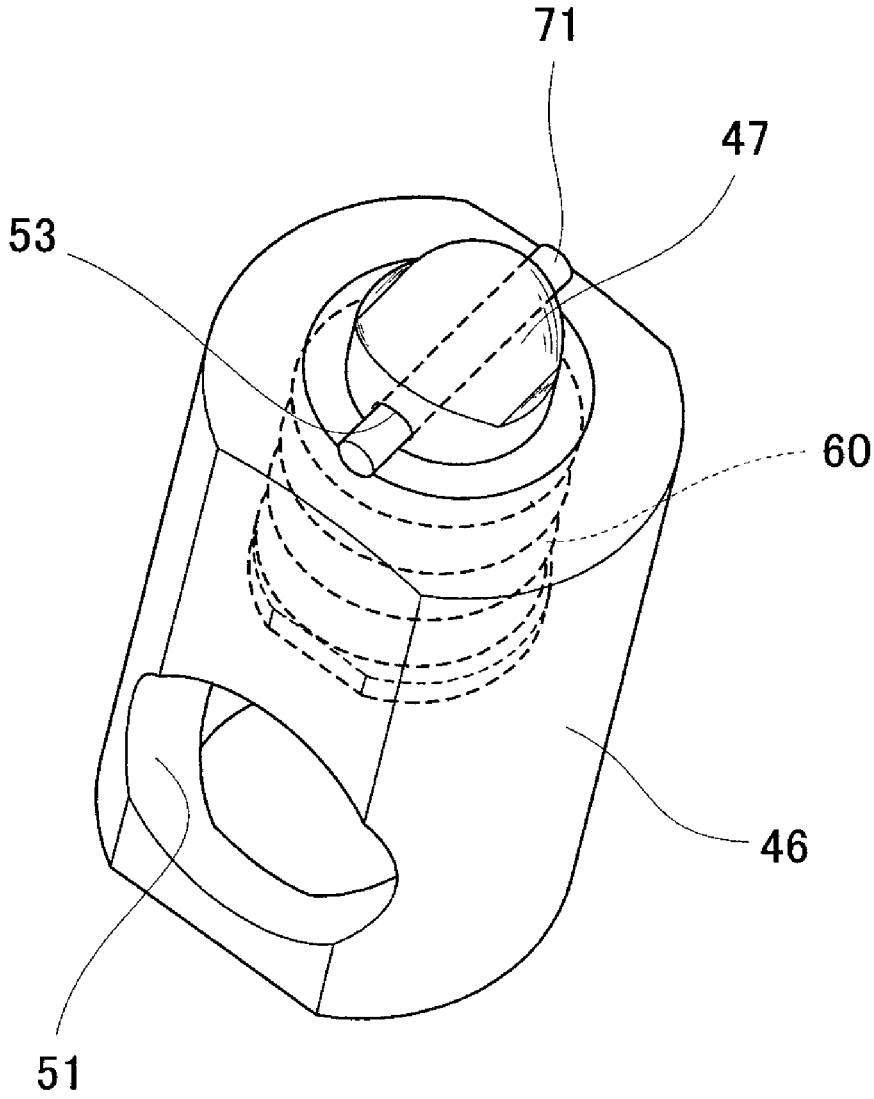
FIG. 18 is a perspective view showing a state where a rod member is inserted into an assembly hole of the decompression pin inserted into the sleeve in an assembly process.
Figure 19:
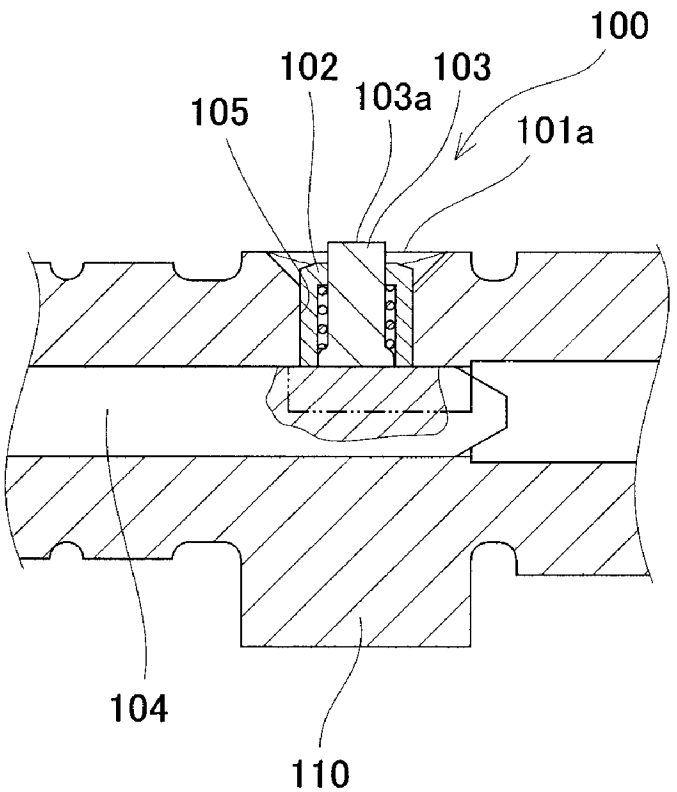
Fig. 19 PRIOR ART
FIG. 19 is a view showing a decompression mechanism according to a prior art.

FIG. 18 is a perspective view showing a state where a rod member 71 is inserted into the assembly hole 53 of the decompression pin 47 inserted into the sleeve 46 in the assembly process. The decompression pin 47 is disposed such that the outward flange 52 is closer to the end of sleeve 46 in the axial one direction A2 than the insertion hole 51 of the sleeve 46, i.e., radially outward of the camshaft 22. In the assembly process, to dispose the decompression pin 47 in this position, the decompression pin 47 is pressed into the sleeve 46 such that the assembly hole 53 is exposed outside the protruding hole 50, and the rod member 71 is inserted into the assembly hole 53 which is exposed outside. Thus, the base end portion of the decompression pin 47 is disposed radially outward relative to the insertion hole 51 of the sleeve 46. Thereby, there is no obstacle in the insertion hole 51 of the sleeve 46, facilitating the insertion of the decompression shaft 48 into the insertion hole 51 of the sleeve 46 as described later. The rod member 71 is pulled out after the decompression shaft 48 is inserted into the insertion hole 51.

In accordance with the decompression mechanism 45 configured as described above, the decompression shaft 48 is inserted through the sleeve 46 to cause the sleeve 46 to be fixed within the insertion hole 41*b*. This makes it possible to avoid the sleeve 46 coming off from the exhaust cam 41 due to a centrifugal force generated by the rotation of the camshaft 22. In addition, so long as the sleeve 46 is insertable into the insertion hole 41*b*, the decompression shaft 48 allows the sleeve 46 to be fixed. This lessens restriction of the outer shape of the sleeve 46. Therefore, the outer dimension of the sleeve 46 does not need high accuracy. By setting the dimension of the sleeve 46 smaller than the dimension of the insertion hole 41*b*, the sleeve 46 is easily incorporated into the decompression mechanism 45. This improves productivity of the decompression mechanism 45. Furthermore, the decompression mechanism 45 is easily incorporated into the engine 5 and the motorcycle 1, and as a result, productivity of the engine 5 and the motorcycle 1 is improved.

In the decompression mechanism 45, when the contact surface 47*a* of the decompression pin 47 contacts the exhaust locker arm 42B, the edge line L2 of the contact surface 47*a* is parallel to the cam axis L4 of the camshaft 22 as viewed from above, and therefore the contact surface 47*a* linearly contacts the exhaust locker arm 42B. By causing the contact surface 47*a* to linearly contact the exhaust locker arm 42B, the pressure applied to the contact surface 47*a* can be reduced and wear-out of the contact surface 47*a* can be reduced, as compared to the configuration in which the contact surface 47*a* makes point-contact with the exhaust locker arm 42B. If the contact surface 47*a* has worn out, the sleeve 46 and the decompression pin 47 are changed, but the exhaust cam 41 need not be changed.

In the decompression mechanism 45, since the decompression shaft 48 is inserted through the sleeve 46, the axial rotation of the sleeve 46 with respect to the camshaft 22 is inhibited. In addition, the flat portions 46*a* and 52*a* formed at the sleeve 46 and the decompression pin 47 are capable of inhibiting the decompression pin 47 from rotating around the axis of the sleeve 46 with respect to the sleeve 46. As a result, the decompression pin 47 is inhibited from rotating around the axis of the sleeve 46 with respect to the camshaft 22, and the edge line L2 of the contact surface 47*a* and the cam axis L4 of the camshaft 22 are maintained to be parallel to each other. This makes it possible to prevent the uneven contact of the decompression pin 47 with respect to the exhaust locker arm 42B. Therefore, it is possible to avoid that the contact surface 47*a* wears out unevenly due to the uneven contact. As a result, it is possible to avoid that a torque required at the start of the engine 5 varies.

The outer diameter of the decompression shaft 48 is set smaller than the diameter of the insertion hole 51 of the sleeve 46 so that a clearance is formed between the decompression shaft 48 and the sleeve 46. In addition, a clearance is formed between the sleeve 46 and the exhaust cam 41. Thereby, even if the edge line L2 of the contact surface 47*a* is not parallel to the cam axis L4 of the camshaft 22 as viewed from above, the sleeve 46 automatically adjusts its attitude such that the sleeve 46 is displaced with respect to the camshaft 22 to cause the edge line L2 to become parallel to the cam axis L4. This makes it possible to have linear contact between the decompression pin 47 and the exhaust locker arm 42B all the time and to avoid the uneven contact between them. Therefore, it is possible to avoid that the contact surface 47*a* wears out unevenly due to the uneven contact. As a result, it is possible to avoid that a torque required at the start of the engine 5 varies.

Since the clearance is formed between the sleeve 46 and the decompression pin 47, the decompression pin 47 is displaced relative to the sleeve 46 so as to linearly contact the exhaust locker arm 42B, thus changing the attitude of the sleeve 46. The sleeve 46 changes its attitude to a stable condition in which the decompression pin 47 is in even contact with the exhaust locker arm 42B. This also makes it possible to avoid that the contact surface 47*a* wears out unevenly due to the uneven contact.

Since the sleeve 46 and the decompression pin 47 do not need high dimension accuracy, a yield of them can be improved. The sleeve 46 and the decompression pin 47 can be manufactured by casting using a lost-wax process, or the like, or by a sintering process. Therefore, the sleeve 46 and the decompression pin 47 can be easily manufactured.

Since the decompression shaft 48 is used to fix the sleeve 46, a member for fixing the sleeve 46 need not be additionally provided. The sleeve 46 can be fixed with a simple structure without increasing the members in number.

Since the decompression pin 47 is configured to be placed on the circular-arc portion 48*b* and the flat portion 54 of the decompression shaft 48, the axial length of the decompression pin 47 becomes short. That is, the size of the decompression pin 47 can be reduced. Thus, the decompression pin 47 can be provided at the exhaust cam 41. Therefore, the decompression mechanism 45 can be provided in, for example, the locker arm type valve operating system in which the width of the exhaust cam 41 is equal to the width of the axial one end portion 43*a* of the exhaust locker arm 42B in the direction along the axis L1.

Since the decompression pin 47 is configured to be placed on the circular-arc portion 48*b* and the flat portion 54 of the decompression shaft 48, the hole diameter of the through-hole 61 of the camshaft 22 is allowed to substantially conform to the outer diameter of the decompression shaft 48. This increases the stiffness of the camshaft 22 as compared to the structure in which the hole diameter of the through-hole 61 of the camshaft 22 is larger than the outer diameter of the decompression shaft 48.

Having described an example in which the engine 5 is applied to the motorcycle 1, the present invention is applicable to vehicles such as four-wheeled vehicles such as ATV or small watercraft such as PWC, generators, lawn mowers, etc. including the engine 5. To be specific, the present invention is applicable to an apparatus which needs to change lift characteristics of a valve. Whereas the motorcycle 1 is a cruiser-type motorcycle, it may be a racer-type motorcycle.

The engine 5 of this embodiment is a V-type two-cylinder engine. The cylinders of the engine 5 may be arranged in parallel or in series and may be one or three or more in number.

Whereas in this embodiment, the valve operating system 21 is a SOHC type valve operating system, it may be an over head valve (OHV) type valve operating system, or a double overhead cam (DOHC) type valve operating system, and the same advantages are achieved in these valve systems. Whereas in this embodiment, the crankshaft 18 and the camshaft 22 are rotatable in association with each other using the timing chain 26, they may be configured to be rotatable in association with each other using gear trains or a drive shaft. Whereas in this embodiment, the decompression mechanism 45 is provided at the exhaust cam 41, the same mechanism may alternatively be provided at the intake cam 40.

Whereas in the valve operating system 21, the exhaust cam 41 is configured to lift the exhaust valve 36 with the exhaust locker arm 42B provided between them, it may be configured to directly contact the exhaust valve 36.

Whereas the decompression shaft 48 is inserted through the sleeve 46 in the direction perpendicular to the flat portion 52*a*, it may be inserted at least in the direction crossing the axis of the sleeve 46 so long as the sleeve 46 can be fixed by the decompression shaft 48. Whereas in this embodiment, the decompression pin 47 and the locker arm 42B are configured to linearly contact each other, the contact surface 47*a* of the decompression pin 47 may be formed to have a partially-spherical shape to allow point contact between them.

Whereas in this embodiment, the decompression pin 47 is extended and retracted according to the rotation of the decompression shaft 48, the decompression shaft 48 may be axially extended and retracted by a driving source such as a solenoid, a motor, or a hydraulic pump.

Alternatively, the decompression shaft 48 may be rotated around the axis L1 or may be extended and retracted in the direction along the axis L1 to change a radial distance between its outer peripheral surface and the axis L1, enabling the decompression pin 47 to be extended and retracted. The latter configuration is achieved by forming the axial one end portion of the decompression shaft 48 in a taper shape.

In a further alternative, the cross-section of the decompression pin 47 in the direction perpendicular to the direction in which the decompression pin 47 is extended and retracted may have a non-circular shape. In this case, the decompression pin 46 is formed to have a portion which is smaller in a radial dimension from its center axis than a portion having a largest radial dimension from the center axis in the state where the decompression pin 47 is inserted into the sleeve 46. This makes it possible to prevent the axial rotation of the decompression pin 47 with respect to the sleeve 46.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A decompression mechanism provided in a valve operating system configured to drive a valve for opening and closing a port, comprising:

an accommodating member provided in the valve operating system;

a decompression member which is accommodated in the accommodating member such that the decompression member is extendable and retractable, the decompression member being configured to extend from the valve operating system to press the valve to open the port in a compression stroke; and an insertion member which is inserted into the valve operating system, the insertion member being configured to be inserted through the accommodating member in a direction crossing a direction in which the decompression member is extendable and retractable.

2. The decompression mechanism according to claim 1, wherein the insertion member is configured to be displaced with respect to the valve operating system to cause the decompression member to be extended and retracted.

3. The decompression mechanism according to claim 1, wherein the decompression member has a tip end surface which is configured to contact the valve or a valve drive member included in the valve operating system to drive the valve, to press the valve;

wherein the tip end surface of the decompression member is configured to linearly contact the valve or the valve drive member; and wherein the accommodating member is configured to inhibit rotation of the decompression member around an axis extending in the direction in which the decompression member is extendable and retractable.

4. The decompression mechanism according to claim 1, wherein the accommodating member is disposed with a gap between the accommodating member and the valve operating system; and wherein the insertion member is inserted through the accommodating member with a gap between the insertion member and the accommodating member.

5. The decompression mechanism according to claim 1, further comprising:

a biasing member configured to apply a force to the decompression member in a direction in which the decompression member is retracted;

wherein the insertion member is disposed so as to support the decompression member against the force applied by the biasing member; and wherein the decompression member has an assembly hole in a tip end portion thereof, the assembly hole extending radially inward.

6. An internal combustion engine comprising a valve operating system including the decompression mechanism according to claim 1.

7. A valve operating system comprising:

a cylindrical camshaft which is driven to rotate around a cam rotational axis, the camshaft having an inner space extending coaxially with the cam rotational axis;

a cam which is fixed to the camshaft and is configured to transmit a driving power for driving a valve for opening and closing a port, the cam being provided with an accommodating hole extending radially inward from an outer peripheral surface of the cam around the cam rotational axis;

an accommodating member which has a substantially tubular shape having open axial end portions and has a through-hole extending along the cam rotational axis in a state where the accommodating member is accommodated in the accommodating hole such that an axial direction of the accommodating member is perpendicular to the cam rotational axis;

a movable member which is accommodated in an inner space of the accommodating member and is partially protrusible from the outer peripheral surface of the cam;

a biasing member configured to apply a force to the movable member in a direction from the accommodating member toward the cam rotational axis;

an adjustment shaft which is accommodated in an inner space formed by the camshaft, is inserted into the through-hole of the accommodating member and is supported by the camshaft such that the adjustment shaft is rotatable around the cam rotational axis, the adjustment shaft having a structure in which a radial dimension between the cam rotational axis and a region of the adjustment shaft which is capable of being opposite to the movable member is non-uniform; and an adjustment shaft drive device configured to cause the adjustment shaft to be angularly displaced around the cam rotational axis to change a location where the region is opposite to the movable member.

* * * * *